US012631105B2

(12) United States Patent
Li et al.

(10) Patent No.: US 12,631,105 B2
(45) Date of Patent: May 19, 2026

(54) DRILLING FRAMEWORK

(71) Applicant: Schlumberger Technology Corporation, Sugar Land, TX (US)

(72) Inventors: Xin Li, Montpellier (FR); Lei Zhu, Beijing (CN); Bo Bi, Beijing (CN); Chao Mu, Beijing (CN); Tao Yu, Beijing (CN); Kewen Sun, Beijing (CN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/526,156

(22) Filed: Dec. 1, 2023

(65) Prior Publication Data

US 2024/0183264 A1 Jun. 6, 2024

Related U.S. Application Data

(60) Provisional application No. 63/429,877, filed on Dec. 2, 2022.

(51) Int. Cl.

| | |
|---|---|
| ***E21B 44/00*** | (2006.01) |
| ***E21B 21/08*** | (2006.01) |
| ***E21B 41/00*** | (2006.01) |
| ***E21B 45/00*** | (2006.01) |

(52) U.S. Cl.

CPC ..... *E21B 44/00* (2013.01); *E21B 41/00* (2013.01); *E21B 21/08* (2013.01); *E21B 45/00* (2013.01)

(58) Field of Classification Search

CPC ..... E21B 44/00; E21B 45/00; E21B 21/08

See application file for complete search history.

(56) References Cited

U.S. PATENT DOCUMENTS

| | | | | |
|---|---|---|---|---|
| 6,883,622 | B2 * | 4/2005 | Beaton | E21B 7/068 175/57 |
| 12,123,295 | B2 * | 10/2024 | Wu | E21B 4/02 |
| 2009/0095469 | A1 * | 4/2009 | Dozier | E21B 41/00 166/250.01 |
| 2012/0024606 | A1 * | 2/2012 | Pirovolou | E21B 44/005 703/10 |
| 2016/0290118 | A1 * | 10/2016 | Xue | G05B 15/02 |

(Continued)

OTHER PUBLICATIONS

"Corva AI", downloaded from the internet on Jan. 6, 2025 from [https://www.corva.ai/company/about-corva-real-time-energy-data-solutions], 2025, 13 pages.

*Primary Examiner* — Tara Schimpf
*Assistant Examiner* — Ursula Lee Norris
(74) *Attorney, Agent, or Firm* — Kyle R. Miiller

(57) ABSTRACT

A method may include receiving a digital well plan that specifies planned drilling parameters for drilling a borehole, where each of the specified planned drilling parameters includes one or more of a minimum threshold and a maximum threshold; generating statistical distributions of actual drilling parameters in real-time responsive to receipt of real-time data acquired during a depth-based window for the drilling; generating comparisons in real-time, where each of the comparisons is between one of the statistical distributions and a corresponding one of the planned drilling parameters for the depth-based window; and, responsive to one or more of the comparisons indicating an unacceptable actual to planned parameter deviation, issuing a control signal.

18 Claims, 13 Drawing Sheets

(56) References Cited

U.S. PATENT DOCUMENTS

| | | | | |
|---|---|---|---|---|
| 2018/0171774 | A1* | 6/2018 | Ringer | E21B 47/002 |
| 2019/0293400 | A1* | 9/2019 | Pierbattista | F42D 3/04 |
| 2020/0257420 | A1* | 8/2020 | Ramchune | E21B 41/00 |
| 2023/0046043 | A1* | 2/2023 | Hansen | E21B 7/06 |
| 2023/0125398 | A1* | 4/2023 | Abdelaal | E21B 44/02 175/24 |
| 2023/0349286 | A1* | 11/2023 | Jiang | E21B 47/06 |

* cited by examiner

600

| Number position | Description |
|---|---|
| 1 | Wellbore geometry: plot of the current casing and bit depth. |
| 2 | Depth scale with zoom-in: select the depth interval to be visualized. |
| 3 | Lithology: lithology column (e.g., from drilling operations framework, etc.). |
| 4 | Planned operation window: planned min/max threshold for WOB, RPM, Flow rate, and ROP. |
| 5 | Actual drilling parameter statistics: e.g., output one statistical bar every 10 m drilling and show percentile details in the tooltip. |
| 6 | Risk indicator and alarm: indicate the alarm status in depth index and time axis. Accept comments on an alarm by selecting it in time axis. |
| 7 | Parameter indicator: indicate how well the actual drilling parameter fits in the planned window in a run and across the well. |

Fig. 6

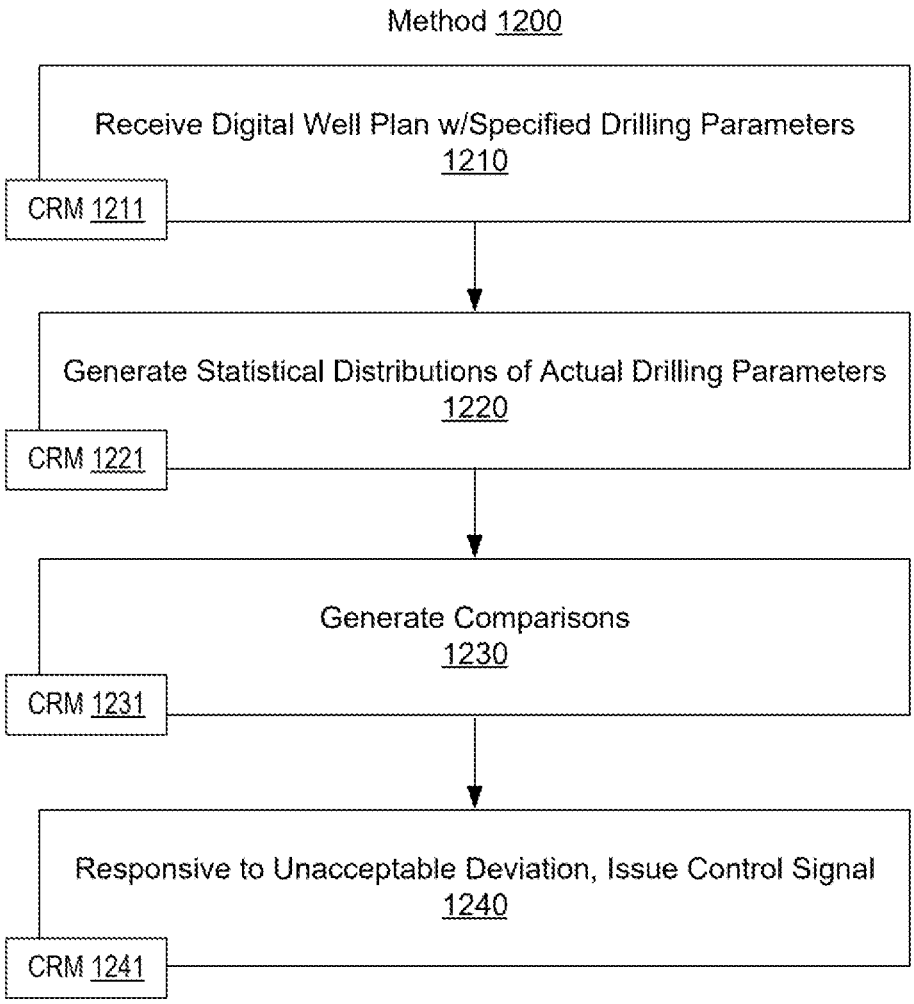
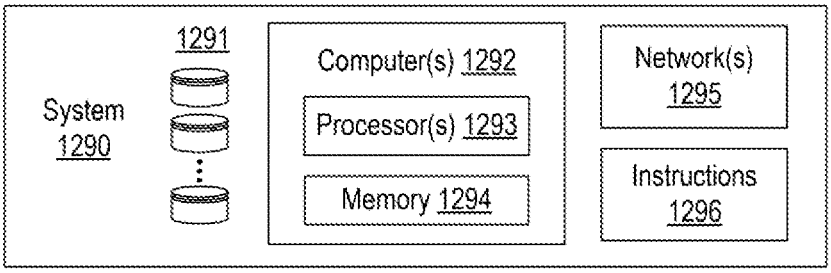
Fig. 12

DRILLING FRAMEWORK

RELATED APPLICATION

This application claims priority to and the benefit of a US Provisional application having Ser. No. 63/429,877, filed 2 Dec. 2022, which is incorporated by reference herein in its entirety.

BACKGROUND

A reservoir may be a subsurface formation that may be characterized at least in part by its porosity and fluid permeability. As an example, a reservoir may be part of a basin such as a sedimentary basin. A basin may be a depression (e.g., caused by plate tectonic activity, subsidence, etc.) in which sediments accumulate. As an example, where hydrocarbon source rocks occur in combination with appropriate depth and duration of burial, a petroleum system may develop within a basin, which may form a reservoir that includes hydrocarbon fluids (e.g., oil, gas, etc.).

In oil and gas exploration, interpretation is a process that involves analysis of data to identify and locate various subsurface structures (e.g., horizons, faults, geobodies, etc.) in a geologic environment. Various types of structures (e.g., stratigraphic formations) may be indicative of hydrocarbon traps or flow channels, as may be associated with one or more reservoirs (e.g., fluid reservoirs). In the field of resource extraction, enhancements to interpretation may allow for construction of a more accurate model of a subsurface region, which, in turn, may improve characterization of the subsurface region for purposes of resource extraction. Characterization of one or more subsurface regions in a geologic environment may guide, for example, performance of one or more operations (e.g., field operations, etc.). As an example, a more accurate model of a subsurface region may make a drilling operation more accurate as to a borehole's trajectory where the borehole is to have a trajectory that penetrates a reservoir, etc., where fluid may be produced via the borehole (e.g., as a completed well, etc.). As an example, one or more workflows may be performed using one or more computational frameworks and/or one or more pieces of equipment that include features for one or more of analysis, acquisition, model building, control, etc., for exploration, interpretation, drilling, fracturing, production, etc.

SUMMARY

A method may include receiving a digital well plan that specifies planned drilling parameters for drilling a borehole, where each of the specified planned drilling parameters includes one or more of a minimum threshold and a maximum threshold; generating statistical distributions of actual drilling parameters in real-time responsive to receipt of real-time data acquired during a depth-based window for the drilling; generating comparisons in real-time, where each of the comparisons is between one of the statistical distributions and a corresponding one of the planned drilling parameters for the depth-based window; and, responsive to one or more of the comparisons indicating an unacceptable actual to planned parameter deviation, issuing a control signal. A system may include one or more processors; memory accessible to at least one of the one or more processors; processor-executable instructions stored in the memory and executable to instruct the system to: receive a digital well plan that specifies planned drilling parameters for drilling a borehole, where each of the specified planned drilling parameters includes one or more of a minimum threshold and a maximum threshold; generate statistical distributions of actual drilling parameters in real-time responsive to receipt of real-time data acquired during a depth-based window for the drilling; generate comparisons in real-time, where each of the comparisons is between one of the statistical distributions and a corresponding one of the planned drilling parameters for the depth-based window; and, responsive to one or more of the comparisons indicating an unacceptable actual to planned parameter deviation, issue a control signal. One or more computer-readable storage media may include processor-executable instructions to instruct a computing system to: receive a digital well plan that specifies planned drilling parameters for drilling a borehole, where each of the specified planned drilling parameters includes one or more of a minimum threshold and a maximum threshold; generate statistical distributions of actual drilling parameters in real-time responsive to receipt of real-time data acquired during a depth-based window for the drilling; generate comparisons in real-time, where each of the comparisons is between one of the statistical distributions and a corresponding one of the planned drilling parameters for the depth-based window; and, responsive to one or more of the comparisons indicating an unacceptable actual to planned parameter deviation, issue a control signal. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The following detailed description refers to the accompanying drawings. Wherever convenient Features and advantages of the described implementations may be more readily understood by reference to the following description taken in conjunction with the accompanying drawings.

FIG. 6 shows an example of a table;
FIG. 12 shows an example of a method and an example of a system.

DETAILED DESCRIPTION

This description is not to be taken in a limiting sense, but rather is made merely for the purpose of describing the general principles of the implementations. The scope of the described implementations should be ascertained with reference to the issued claims.

Figure 1:
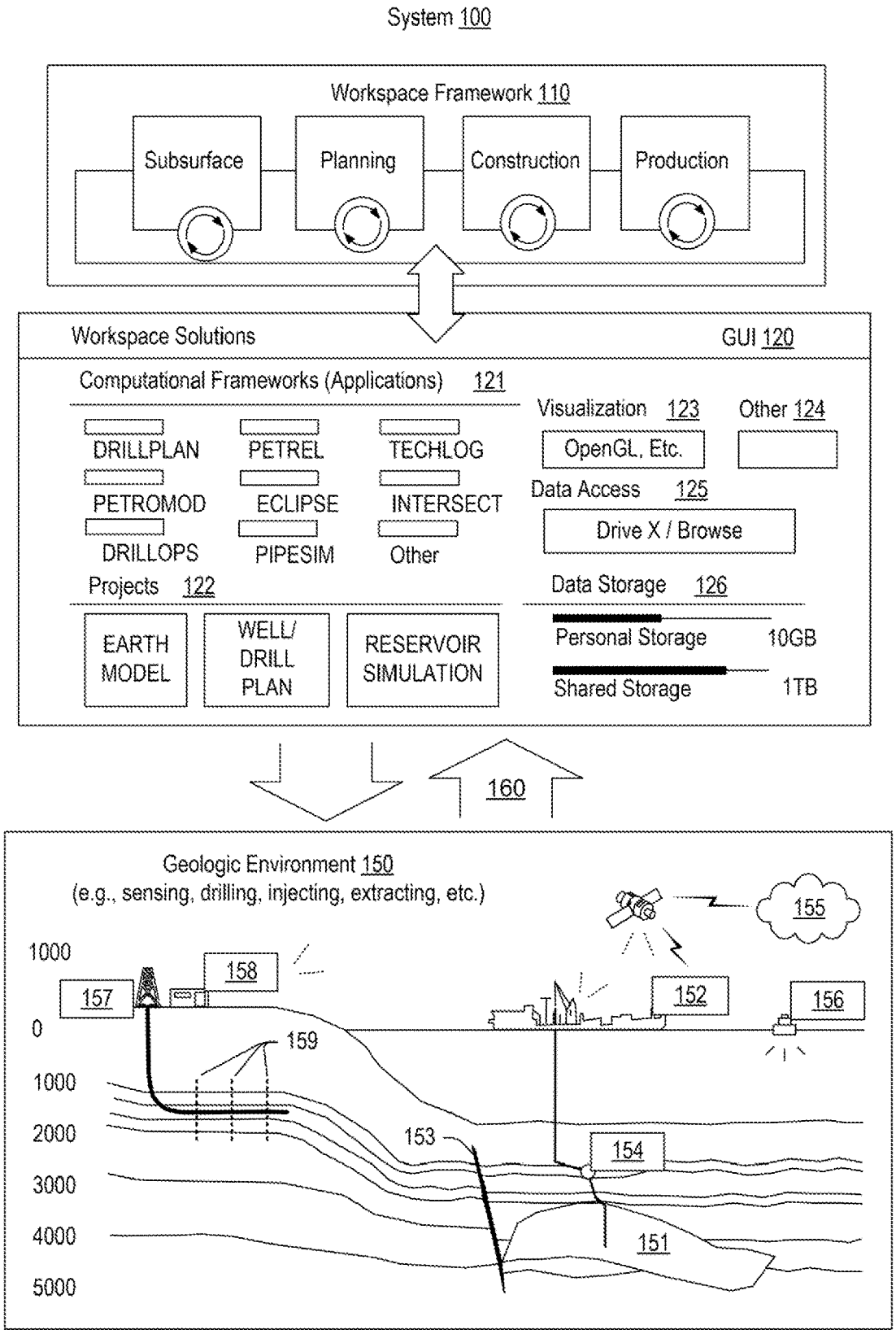
FIG. 1 shows an example of a system.

FIG. 1 shows an example of a system 100 that includes a workspace framework 110 that may provide for instantiation of, rendering of, interactions with, etc., a graphical user interface (GUI) 120. In the example of FIG. 1, the GUI 120 may include graphical controls for computational frameworks (e.g., applications, etc.) 121, projects 122, visualization features 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, DRILLOPS, PETREL, TECHLOG, PETROMOD, ECLIPSE, PIPESIM, and INTERSECT frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The DRILLOPS framework may execute a digital drilling plan and ensures plan adherence, while delivering goal-based automation. The DRILLOPS framework may generate activity plans automatically individual operations, whether they are monitored and/or controlled on the rig or in town. Automation may utilize data analysis and learning systems to assist and optimize tasks, such as, for example, setting ROP to drilling a stand. A preset menu of automatable drilling tasks may be rendered, and, using data analysis and models, a plan may be executed in a manner to achieve a specified goal, where, for example, measurements may be utilized for calibration. The DRILLOPS framework provides flexibility to modify and replan activities dynamically, for example, based on a live appraisal of various factors (e.g., equipment, personnel, and supplies). Well construction activities (e.g., tripping, drilling, cementing, etc.) may be continually monitored and dynamically updated using feedback from operational activities. The DRILLOPS framework may provide for various levels of automation based on planning and/or re-planning (e.g., via the DRILLPLAN framework), feedback, etc.

The PETREL framework may be part of the DELFI environment for utilization in geosciences and geoengineering, for example, to analyze subsurface data from exploration to production of fluid from a reservoir. The DELFI cognitive exploration and production (E&P) environment (SLB, Houston, Texas), referred to herein as the DELFI environment or DELFI framework, is a secure, cognitive, cloud-based collaborative environment that integrates data and workflows with digital technologies, such as artificial intelligence and machine learning.

The PETREL framework provides components that allow for optimization of various exploration, development and production operations. The PETREL framework includes seismic to simulation software components that may output information for use in increasing reservoir performance, for example, by improving asset team productivity. Through use of such a framework, various professionals (e.g., geophysicists, geologists, and reservoir engineers) may develop collaborative workflows and integrate operations to streamline processes (e.g., with respect to one or more geologic environments, etc.). Such a framework may be considered an application (e.g., executable using one or more devices) and may be considered a data-driven application (e.g., where data is input for purposes of modeling, simulating, etc.).

The TECHLOG framework may handle and process field and laboratory data for a variety of geologic environments (e.g., deepwater exploration, shale, etc.). The TECHLOG framework may structure wellbore data for analyses, planning, etc.

The PETROMOD framework provides petroleum systems modeling capabilities that may combine one or more of seismic, well, and geological information to model the evolution of a sedimentary basin. The PETROMOD framework may predict if, and how, a reservoir has been charged with hydrocarbons, including the source and timing of hydrocarbon generation, migration routes, quantities, and hydrocarbon type in the subsurface or at surface conditions.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework may produce reliable results, which may be continuously updated by real-time data exchanges (e.g., from one or more types of data acquisition equipment in the field that may acquire data during one or more types of field operations, etc.). The INTERSECT framework may provide completion configurations for complex wells where such configurations may be built in the field, may provide detailed enhanced-oil-recovery (EOR) formulations where such formulations may be implemented in the field, may analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI environment, for example, for rapid simulation of multiple concurrent cases. For example, a workflow may utilize one or more of the DELFI environment on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 may be utilized for directing, controlling, etc., one or more processes in the geologic environment 150 and, feedback 160, may be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G frameworks (e.g., consider the PETREL framework, etc.).

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, a visualization process may implement one or more of various features that may be suitable for one or more web applications. For example, a template may involve use of the JAVASCRIPT object notation format (JSON) and/or one or more other languages/formats. As an example, a framework may include one or more converters. For example, consider a JSON to PYTHON converter and/or a PYTHON to JSON converter. Such an approach may provide for compatibility of devices, frameworks, etc., with respect to one or more sets of instructions.

As an example, visualization features may provide for visualization of various earth models, properties, etc., in one or more dimensions. As an example, visualization features may provide for rendering of information in multiple dimensions, which may optionally include multiple resolution rendering. In such an example, information being rendered may be associated with one or more frameworks and/or one or more data stores. As an example, visualization features may include one or more control features for control of equipment, which may include, for example, field equipment that may perform one or more field operations. As an example, a workflow may utilize one or more frameworks to generate information that may be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. As an example, reflection seismology may provide seismic data representing waves of elastic energy (e.g., as transmitted by P-waves and S-waves, in a frequency range of approximately 1 Hz to approximately 100 Hz). Seismic data may be processed and interpreted, for example, to understand better composition, fluid content, extent and geometry of subsurface rocks. Such interpretation results may be utilized to plan, simulate, perform, etc., one or more operations for production of fluid from a reservoir (e.g., reservoir rock, etc.).

Field acquisition equipment may be utilized to acquire seismic data, which may be in the form of traces where a trace may include values organized with respect to time and/or depth (e.g., consider 1D, 2D, 3D or 4D seismic data). For example, consider acquisition equipment that acquires digital samples at a rate of one sample per approximately 4 ms. Given a speed of sound in a medium or media, a sample rate may be converted to an approximate distance. For example, the speed of sound in rock may be on the order of around 5 km per second. Thus, a sample time spacing of approximately 4 ms would correspond to a sample "depth" spacing of about 10 meters (e.g., assuming a path length from source to boundary and boundary to sensor). As an example, a trace may be about 4 seconds in duration; thus, for a sampling rate of one sample at about 4 ms intervals, such a trace would include about 1000 samples where latter acquired samples correspond to deeper reflection boundaries. If the 4 second trace duration of the foregoing example is divided by two (e.g., to account for reflection), for a vertically aligned source and sensor, a deepest boundary depth may be estimated to be about 10 km (e.g., assuming a speed of sound of about 5 km per second).

As an example, a model may be a simulated version of a geologic environment. As an example, a simulator may include features for simulating physical phenomena in a geologic environment based at least in part on a model or models. A simulator, such as a reservoir simulator, may simulate fluid flow in a geologic environment based at least in part on a model that may be generated via a framework that receives seismic data. A simulator may be a computerized system (e.g., a computing system) that may execute instructions using one or more processors to solve a system of equations that describe physical phenomena subject to various constraints. In such an example, the system of equations may be spatially defined (e.g., numerically discretized) according to a spatial model that that includes layers of rock, geobodies, etc., that have corresponding positions that may be based on interpretation of seismic and/or other data. A spatial model may be a cell-based model where cells are defined by a grid (e.g., a mesh). A cell in a cell-based model may represent a physical area or volume in a geologic environment where the cell may be assigned physical properties (e.g., permeability, fluid properties, etc.) that may be germane to one or more physical phenomena (e.g., fluid volume, fluid flow, pressure, etc.). A reservoir simulation model may be a spatial model that may be cell-based.

A simulator may be utilized to simulate the exploitation of a real reservoir, for example, to examine different productions scenarios to find an optimal one before production or further production occurs. A reservoir simulator does not provide an exact replica of flow in and production from a reservoir at least in part because the description of the reservoir and the boundary conditions for the equations for flow in a porous rock are generally known with an amount of uncertainty. Certain types of physical phenomena occur at a spatial scale that may be relatively small compared to size of a field. A balance may be struck between model scale and computational resources that results in model cell sizes being of the order of meters; rather than a lesser size (e.g., a level of detail of pores). A modeling and simulation workflow for multiphase flow in porous media (e.g., reservoir rock, etc.) may include generalizing real micro-scale data from macro scale observations (e.g., seismic data and well data) and upscaling to a manageable scale and problem size. Uncertainties may exist in input data and solution procedure such that simulation results too are to some extent uncertain. A process known as history matching may involve comparing simulation results to actual field data acquired during production of fluid from a field. Information gleaned from history matching, may provide for adjustments to a model, data, etc., which may help to increase accuracy of simulation.

As an example, a simulator may utilize various types of constructs, which may be referred to as entities. Entities may include earth entities or geological objects such as wells, surfaces, reservoirs, etc. Entities may include virtual representations of actual physical entities that may be reconstructed for purposes of simulation. Entities may include entities based on data acquired via sensing, observation, etc. (e.g., consider entities based at least in part on seismic data and/or other information). As an example, an entity may be characterized by one or more properties (e.g., a geometrical pillar grid entity of an earth model may be characterized by a porosity property, etc.). Such properties may represent one or more measurements (e.g., acquired data), calculations, etc.

As an example, a simulator may utilize an object-based software framework, which may include entities based on pre-defined classes to facilitate modeling and simulation. As an example, an object class may encapsulate reusable code and associated data structures. Object classes may be used to instantiate object instances for use by a program, script, etc. For example, borehole classes may define objects for representing boreholes based on well data. A model of a basin, a reservoir, etc. may include one or more boreholes where a borehole may be, for example, for measurements, injection, production, etc. As an example, a borehole may be a wellbore of a well, which may be a completed well (e.g., for production of a resource from a reservoir, for injection of material, etc.).

While several simulators are illustrated in the example of FIG. 1, one or more other simulators may be utilized, additionally or alternatively. For example, consider the VISAGE geomechanics simulator (SLB, Houston Texas) or the PIPESIM network simulator (SLB, Houston Texas), etc. The VISAGE simulator includes finite element numerical solvers that may provide simulation results such as, for example, results as to compaction and subsidence of a geologic environment, well and completion integrity in a geologic environment, cap-rock and fault-seal integrity in a geologic environment, fracture behavior in a geologic environment, thermal recovery in a geologic environment, CO2 disposal, etc. The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that may optimize one or more operational scenarios at least in part via simulation of physical phenomena. The MANGROVE simulator (SLB, Houston, Texas) provides for optimization of stimulation design (e.g., stimulation treatment operations such as hydraulic fracturing) in a reservoir-centric environment. The MANGROVE framework may combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well). The MANGROVE framework may provide results pertaining to heterogeneous interactions between hydraulic and natural fracture networks, which may assist with optimization of the number and location of fracture treatment stages (e.g., stimulation treatment(s)), for example, to increased perforation efficiency and recovery.

As an example, data may include geochemical data. For example, consider data acquired using X-ray fluorescence (XRF) technology, Fourier transform infrared spectroscopy (FTIR) technology and/or wireline geochemical technology.

As an example, one or more probes may be deployed in a bore via a wireline or wirelines. As an example, a probe may emit energy and receive energy where such energy may be analyzed to help determine mineral composition of rock surrounding a bore. As an example, nuclear magnetic resonance may be implemented (e.g., via a wireline, downhole NMR probe, etc.), for example, to acquire data as to nuclear magnetic properties of elements in a formation (e.g., hydrogen, carbon, phosphorous, etc.).

As an example, lithology scanning technology may be employed to acquire and analyze data. For example, consider the LITHO SCANNER technology (SLB, Houston, Texas). As an example, a LITHO SCANNER tool may be or include a gamma ray spectroscopy tool.

As an example, a tool may be positioned to acquire information in a portion of a borehole. Analysis of such information may reveal vugs, dissolution planes (e.g., dissolution along bedding planes), stress-related features, dip events, etc. As an example, a tool may acquire information that may help to characterize a fractured reservoir, optionally where fractures may be natural and/or artificial (e.g., hydraulic fractures). Such information may assist with completions, stimulation treatment, etc. As an example, information acquired by a tool may be analyzed using a framework such as the aforementioned TECHLOG framework.

As an example, a workflow may utilize one or more types of data for one or more processes (e.g., stratigraphic modeling, basin modeling, completion designs, drilling, production, injection, etc.). As an example, one or more tools may provide data that may be used in a workflow or workflows that may implement one or more frameworks (e.g., PETREL, TECHLOG, PETROMOD, ECLIPSE, etc.).

In the example of FIG. 1, drilling may be performed in the geologic environment 150, for example, to access the reservoir 151, which may be accessed from land or offshore. In FIG. 1, the downhole equipment 154 may be, for example, part of a bottom hole assembly (BHA). The BHA may be used to drill a well. The downhole equipment 154 may communicate information to equipment at the surface, and may receive instructions and information from the equipment at the surface. During a well construction process, a variety of operations (such as cementing, wireline evaluation, testing, etc.) may be conducted. In such embodiments, data collected by tools and sensors and used for reasons such as reservoir characterization may be collected and transmitted.

A well may include a substantially horizontal portion (e.g., lateral portion) that may intersect with one or more fractures. For example, a well in a shale formation may pass through natural fractures, artificial fractures (e.g., hydraulic fractures), or a combination thereof. Such a well may be constructed using directional drilling techniques as described herein. However, these same techniques may be used in connection with other types of directional wells (such as slant wells, S-shaped wells, deep inclined wells, and others) and are not limited to horizontal wells.

Figure 2:
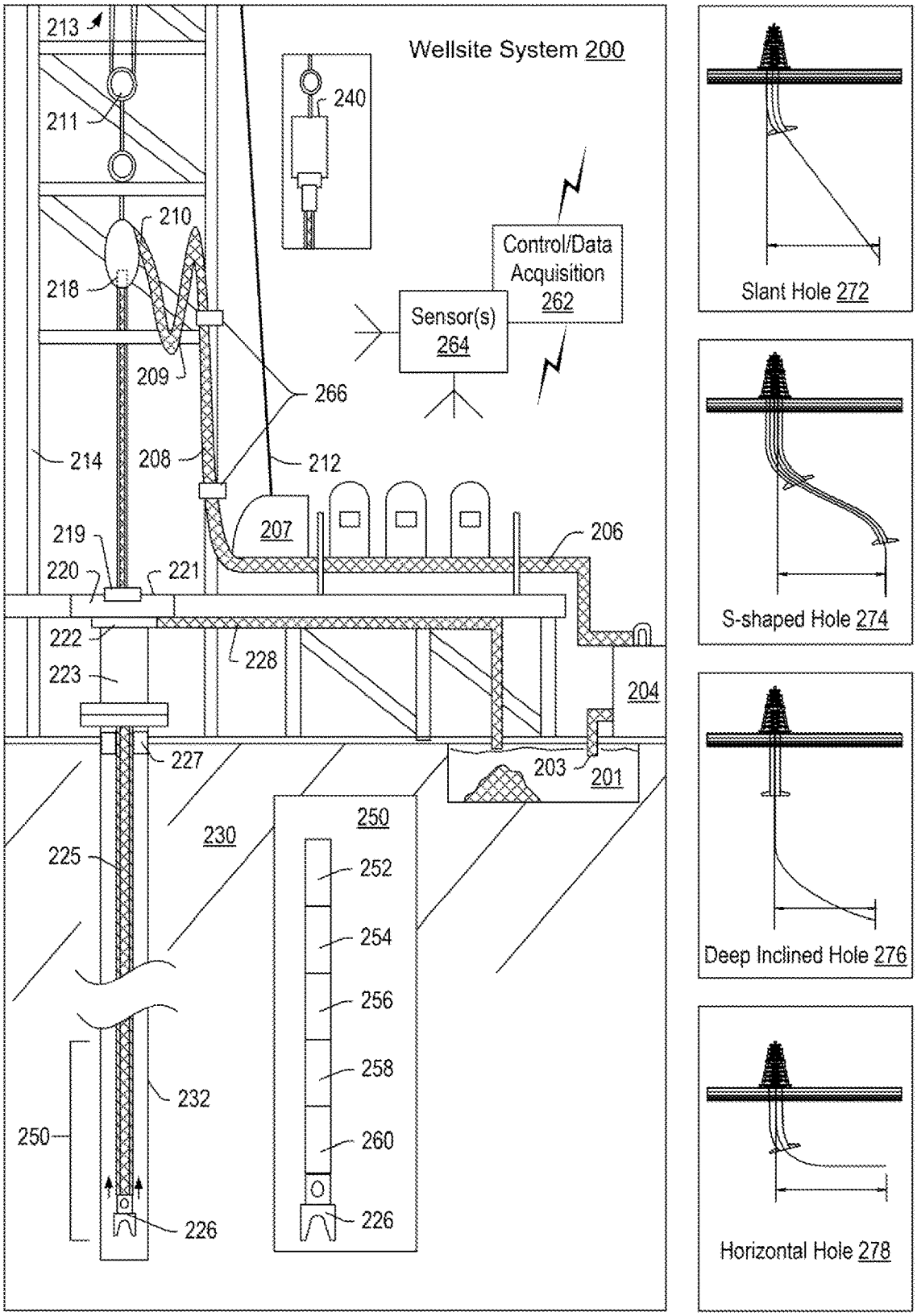
FIG. 2 shows an example of a system.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212, a derrick 214, a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the traveling block 211 and the derrick 214 positioned over the borehole 232. As mentioned, the wellsite system 200 may include the rotary table 220 where the drillstring 225 pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring may include a plurality of tools.

As to a RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a mud motor (e.g., PDM) may be operated in different modes, which may include a rotating mode and a sliding mode. A sliding mode involves drilling with a mud motor rotating the bit downhole without rotating the drillstring from the surface. Such an operation may be conducted when a BHA has been fitted with a bent sub or a bent housing mud motor, or both, for directional drilling. Sliding may be used in building and controlling or adjusting hole angle. In directional drilling, pointing of a bit may be accomplished through a bent sub, which may have a relatively small angle offset from the axis of a drillstring, and a measurement device to determine the direction of offset. Without turning the drillstring, the bit may be rotated with mud flow through the mud motor to drill in the direction it is pointed. With steerable motors, when a desired wellbore direction is attained, the entire drillstring may be rotated to drill straight rather than at an angle. By controlling the amount of hole drilled in the sliding mode versus the rotating mode, a wellbore trajectory may be controlled rather precisely.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface. In such an example, a bit RPM may be determined or estimated based on the RPM of the mud motor.

An RSS may drill directionally where there is continuous rotation from surface equipment, which may alleviate the sliding of a steerable motor (e.g., a PDM). A RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and may contain one or a plurality of selected types of logging tools. It will also be understood that more than one LWD and/or MWD module may be employed. Where the position of an LWD module is mentioned, as an example, it may refer to a module at the position of the LWD module 254, the MWD module 256, etc. An LWD module may include capabilities for measuring, processing, and storing information, as well as for communicating with the surface equipment. In the illustrated example, the LWD module 254 may include a seismic measuring device.

The MWD module 256 may be housed in a suitable type of drill collar and may contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring may include a positive displacement motor (PDM).

As an example, a system may be a steerable system and include equipment to perform method such as geosteering. As mentioned, a steerable system may be or include an RSS. As an example, a steerable system may include a PDM or of a turbine on a lower part of a drillstring which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this may refer to a portion of a drillstring that cannot be rotated or moved axially. As an example, a condition referred to as "differential sticking" may be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as may a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus.

Figure 3:
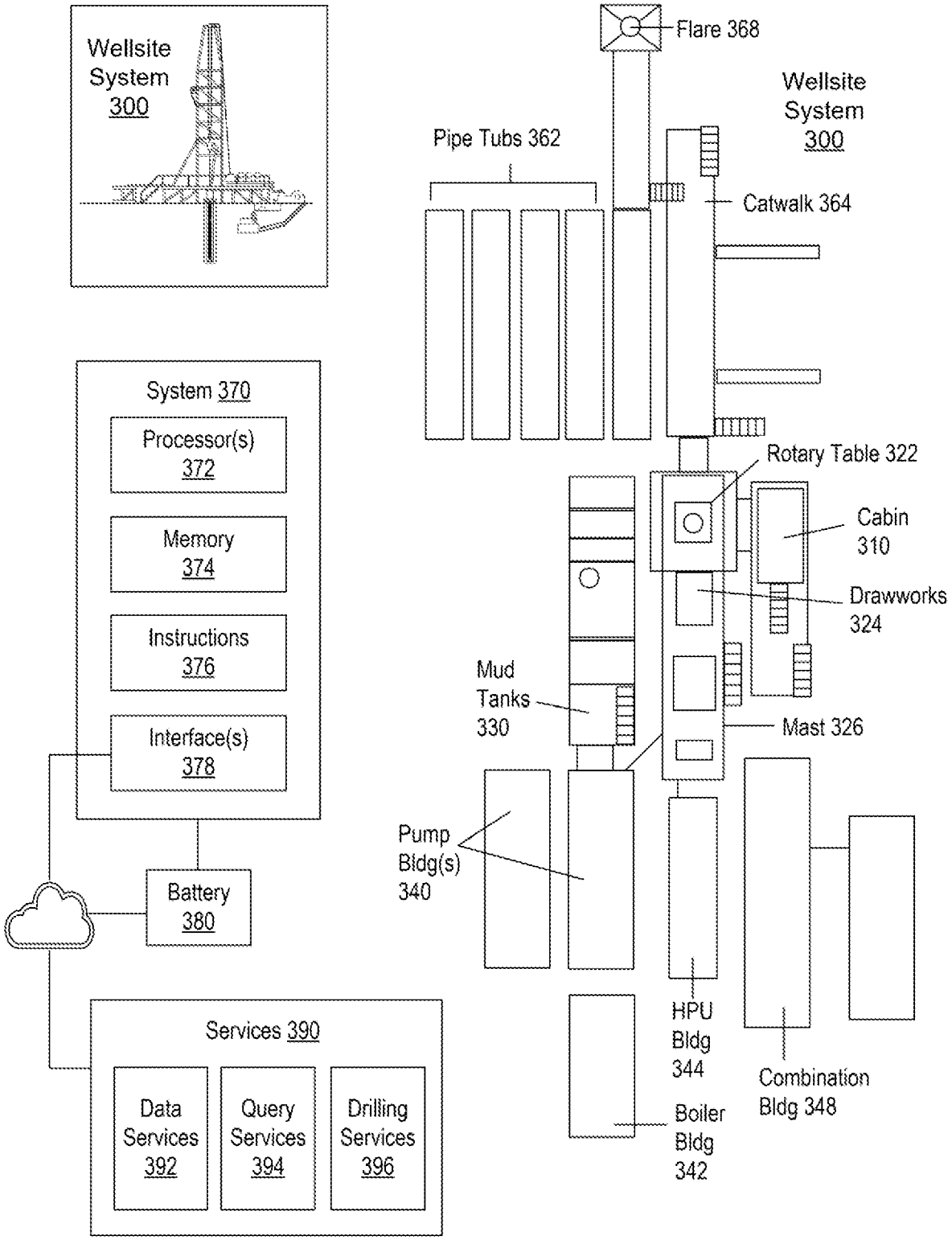
FIG. 3 shows an example of a system.

FIG. 3 shows an example of a wellsite system 300, specifically, FIG. 3 shows the wellsite system 300 in an approximate side view and an approximate plan view along with a block diagram of a system 370.

In the example of FIG. 3, the wellsite system 300 may include a cabin 310, a rotary table 322, drawworks 324, a mast 326 (e.g., optionally carrying a top drive, etc.), mud tanks 330 (e.g., with one or more pumps, one or more shakers, etc.), one or more pump buildings 340, a boiler building 342, an HPU building 344 (e.g., with a rig fuel tank, etc.), a combination building 348 (e.g., with one or more generators, etc.), pipe tubs 362, a catwalk 364, a flare 368, etc. Such equipment may include one or more associated functions and/or one or more associated operational risks, which may be risks as to time, resources, and/or humans.

As shown in the example of FIG. 3, the wellsite system 300 may include a system 370 that includes one or more processors 372, memory 374 operatively coupled to at least one of the one or more processors 372, instructions 376 that may be, for example, stored in the memory 374, and one or more interfaces 378. As an example, the system 370 may include one or more processor-readable media that include processor-executable instructions executable by at least one of the one or more processors 372 to cause the system 370 to control one or more aspects of the wellsite system 300. In such an example, the memory 374 may be or include the one or more processor-readable media where the processor-executable instructions may be or include instructions. As an example, a processor-readable medium may be a computer-readable storage medium that is not a signal and that is not a carrier wave.

FIG. 3 also shows a battery 380 that may be operatively coupled to the system 370, for example, to power the system 370. As an example, the battery 380 may be a back-up battery that operates when another power supply is unavailable for powering the system 370. As an example, the battery 380 may be operatively coupled to a network, which may be a cloud network. As an example, the battery 380 may include smart battery circuitry and may be operatively coupled to one or more pieces of equipment via a SMBus or other type of bus.

In the example of FIG. 3, services 390 are shown as being available, for example, via a cloud platform. Such services may include data services 392, query services 394 and drilling services 396. As an example, the services 390 may be part of a system such as the system 100 of FIG. 1 (e.g., consider planning services and/or operational services). As an example, the services 390 may include one or more services for directional drilling (e.g., consider a computational framework that may provide for one or more services that utilize real-time data to estimate one or more parameters, etc.).

As an example, the system 370 may be utilized to generate one or more rate of penetration drilling parameter values, which may, for example, be utilized to control one or more drilling operations.

As an example, a method may include automating operations of one or more types of downhole tools. For example, consider automating operations of one or more of mud motors, rotary steerable systems (RSSs) and at-bit steerable systems (ABSSs). As an example, one or more of such types of equipment, systems, etc., may be implemented using one or more features of the system 200 of FIG. 2.

As an example, an ABSS may include an actuator with a pressure drop range, hold inclination and azimuth (HIA), and dual downlinking capabilities. As an example, an ABSS may include onboard near-bit sensors that may acquire continuous six-axis inclination and azimuth measurements with a 6-ft range, and optional natural gamma ray and azimuthal images with a 9-ft range. As an example, an ABSS may include one of more features of one or more of the NEOSTEER family of ABSSs (SLB, Houston, Texas).

As an example, a framework may provide for considering information from planning with offset analysis and adapting a hybrid model for real time execution; considering various downhole automation possibilities at a given time to optimize a recommended working trajectory execution, taking advantage of tool capabilities and minimizing unnecessary surface actions; considering real-time data information and derived tool health as well as tool state estimation at a given point in time to optimize current ongoing recommendation and recommend real time correction to handle deviations when it occurs. Such an approach may involve different computations and actions that may output an optimal recommendation, for example, for a fastest path with minimized risk based on the drilling constraints and the drilling context.

As to an optimal path recommendation, derivation may be via a framework, which may provide for a single-target approach and/or a multi-target approach and, for example, which may account for various factors, which may include energy, emissions, etc.

Figure 4:
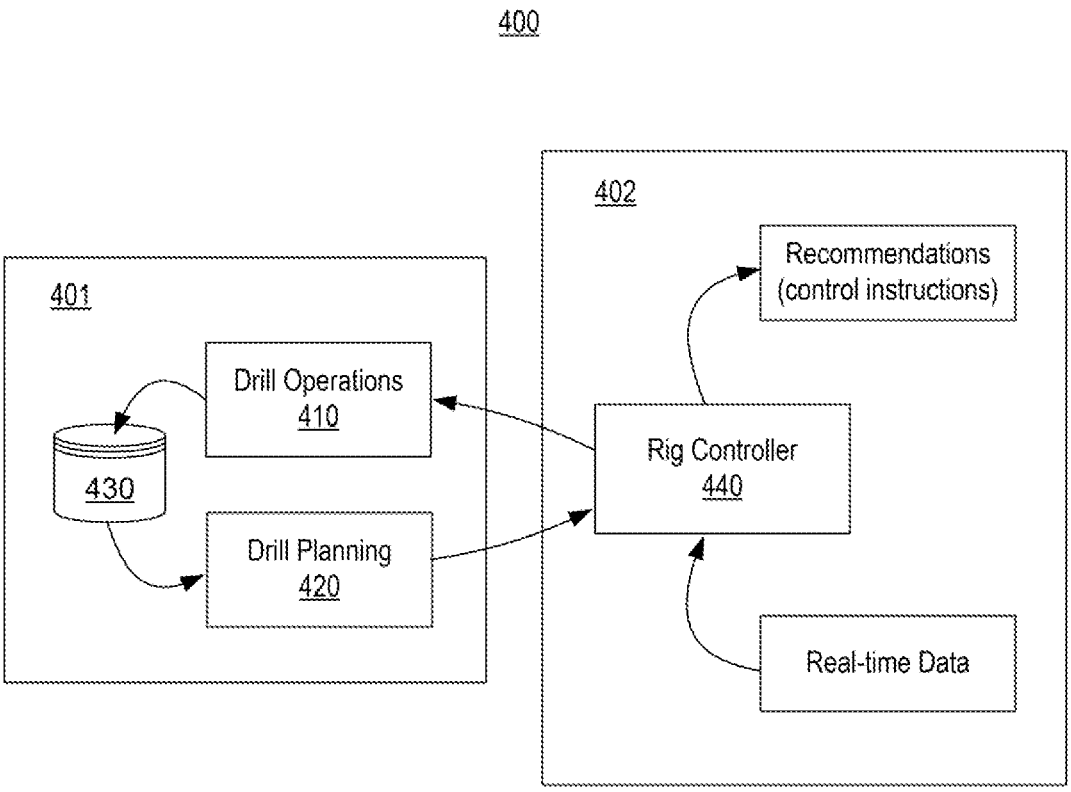
FIG. 4 shows an example of a system.

FIG. 4 shows an example of a system 400 that includes offsite equipment 401 (e.g., remote) and onsite equipment 402 (e.g., local). As shown, the offsite equipment 401 may include a drill operations framework 410, a drill planning framework 420 and a database 430 and the onsite equipment 402 may include a controller 440 that may receive real-time data and output recommendations such as control instructions to control onsite equipment. In such an example, the drill operations framework 410 may provide for steering sheets, execution parameters, etc., and the drill planning framework 420 may provide for evaluation of steering responses and statistics. As shown, the controller 440 may output information to the drill operations framework 410 and receive information from the drill planning framework 420. The system 400 may include plan generation features for real-time plan generation during drilling operations execution phase and/or plan generation during a planning phase. The system 400 may be utilized for one or more types of drilling (e.g., rotary, mud motor, RSS, ABSS, etc.). The system 400 may operate loops, which may include at least one real-time loop that provides for control of equipment to perform drilling operations.

A system such as the system 400 may utilize various functions and penalties for generation of plans, which may provide for single or multiple target aiming. As explained, a plan may be generated that aims to provide for drilling operations that aim for multiple targets simultaneously.

Figure 5:
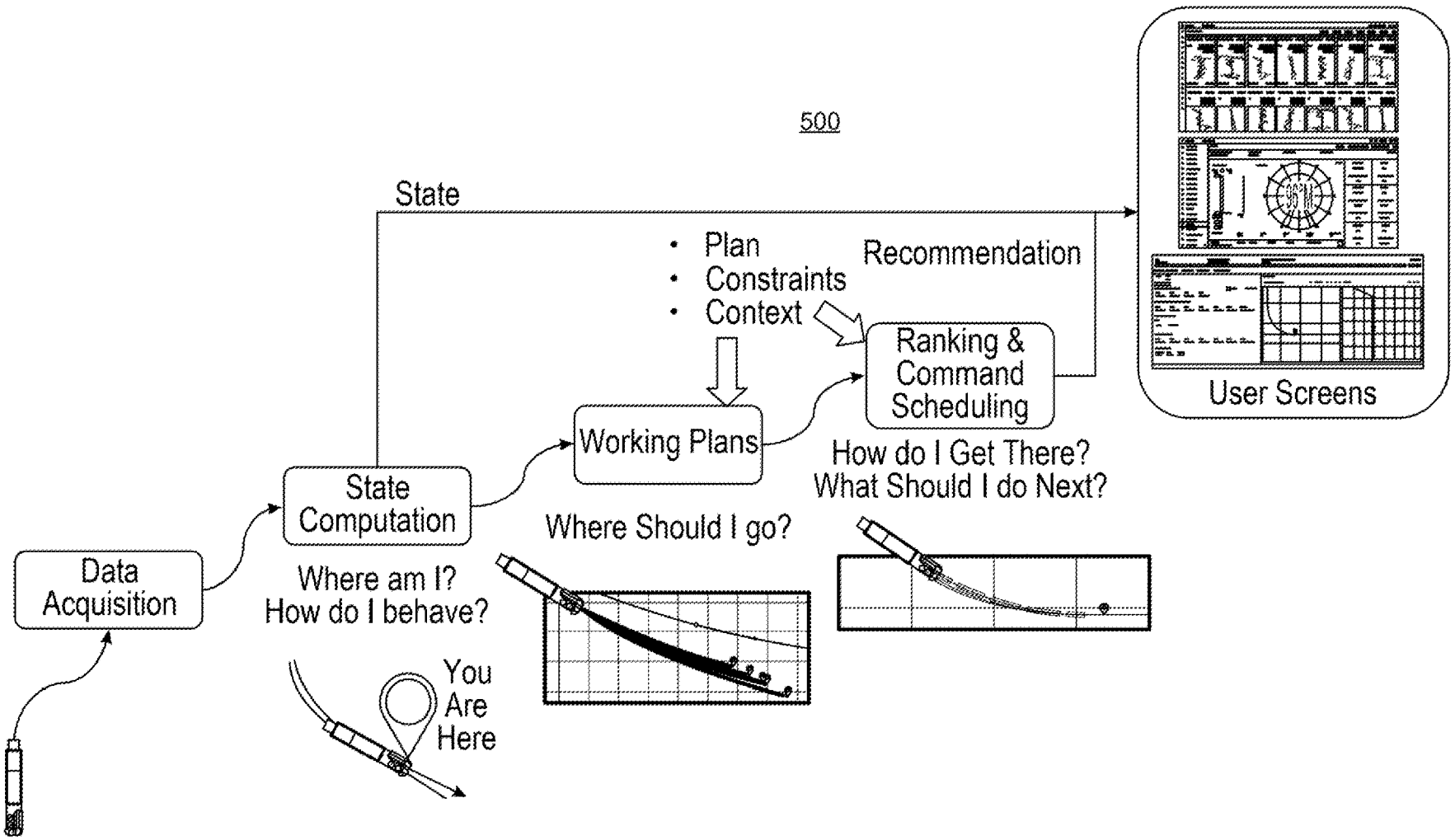
FIG. 5 shows an example of a system.

FIG. 5 shows an example of a workflow 500 that includes data acquisition, state computation, working plans generation, ranking and command scheduling and user selections. As shown, such a workflow may be implemented during drilling operations at a site. For example, data acquired may be real-time data and state computation may compute a state of where a BHA or other tool is located in a wellbore. As to working plan generation (WPG), it may answer the question of where to proceed, which may be based on a current plan, constraints and context. As an example, ranking and command scheduling may be performed where commands may be suitable for automated and/or manual execution. Recommendations from such a workflow may be rendered to one or more displays where, for example, one or more GUIs may provide for user interactions.

As an example, a working plan may be or include a trajectory to construct a path from a current bit location to a next target. The construction of such a path may be performed in accordance of aiming at a target where, for example, various trajectory constraints may be considered. For example, consider one or more of the following constraints: allowable deviation from an original plan both in terms of position but also angular deviation; maximum dogleg capability of a steering assembly; recommended constraints by an automatic plan analysis that may be adjustable manually and/or automatically (e.g., according to user preferences, etc.); and allowable tortuosity, risk measures, hole quality, confidence level, etc.

As an example, working plan generation may be performed using a trajectory generator (e.g., for generating multiple trajectory candidates with different conditions) and a ranking system (e.g., for evaluating each of the generated candidates based on trajectory context, different properties, constraint violations, etc.). In such an approach, a WPG may output a single best candidate or few top ranked candidates.

As to the ranking system, it may operate based on a list of classification items that define features selected in order to rank the candidates. For example, consider candidate properties where some examples of these properties may include: trajectory length, ROP, total steering length, toolface orientation, maximum steering ratio, average deviation from the plan, risk level, target constraints, angular deviation, tortuosity, DDI, hole quality, tool wear, number of downlinks, geomechanics, confidence level and production level index. For each property utilized, a weight may be defined based on trajectory context. In such an example, the weight may be associated with a cost function of the candidate to produce a total cost for each candidate trajectory. As to various aspects of drilling, consider the following terms.

- Rotary Steerable System (RSS): Particular downhole tool capable of deviating a wellbore with electronic commands.
- Dogleg Severity (DLS): measure of change in direction of a wellbore over a defined length, normally measured in degrees per 100 feet of length.
- Yield (Y): the maximum DLS capability.
- RealTime Yield (RT Y): the yield at a particular time.
- ToolFace (TF): The angle measured in a plane perpendicular to a drillstring axis that is between a reference direction on the drillstring and a fixed reference.
- Desired Commands: The intended commands sent to the downhole tool.
- Actual Commands: The resulting commands executed by the downhole tool.
- ToolFace Offset (TFo): The angle measured between a desired TF and an actual TF.
- Build Rate (BR): the DLS projected in a vertical plane attached a tool location. It is also a rate of change in inclination.
- Turn Rate (TR): the DLS projected in a horizontal plane. It is also a rate of change in azimuth.
- Walk Rate (WR): the rate of change of azimuth attached to a tool reference axis.
- Steering Ratio (SR): the percentage of time an RSS tool is spending steering (bias) versus trying to go neutral (unbias).
- BRo and WRo: BR and WR during neutral phase.

As an example, a framework may provide for generating output based on one or more inputs. For example, consider a drilling interpretation framework that receives data from real-time channels and context data from a drilling operations rig infrastructure and/or an appropriate server (e.g., a WITSML server) that generates drilling parameters in real-time.

As an example, a framework may include the following inputs: Planned Operation Parameter (e.g., as in a planned BHA run, as may be defined as a WISTML object); Bit Depth; Hole Depth; Hook Load (e.g., to assist in determination of rig activity); Block Position (e.g., to assist in determination of rig activity); Surface Torque (e.g., to assist in determination of rig activity); Surface WOB; Surface RPM; Flow Rate; and ROP. In such an example, outputs may include information for generating a graphical representation of limits set in a digital drilling plan or program (DDP) with drilling parameters that may be rendered (e.g., plotted) in real-time.

As an example, a drilling framework may provide for real-time parameter adherence, for example, via predictive analytics. Predictive analytics may be implemented to provide one or more perspectives for well construction operations. For example, consider predictive analytics that may highlight risks when planned drilling parameters are not followed and the outcome of one or more actions. In such an example, output may be utilized to improve automation of one or more operational tasks. For example, consider automated control responsive to a prediction.

In a planning phase of a well to be drilled, a drilling engineering team may be tasked with consolidating analyses on offset wells or a field block to design trajectory, BHA, casing, and drilling parameters. Additionally, the team may also consider actual rig deployment where an optimum operating window is defined such that, for each drilling run, drilling parameters are appropriately regulated to be within their proper ranges and stored as part of a drill plan project.

As an example, a drilling framework may automatically acquire planned drilling parameters (e.g., with minimum, maximum and recommended values) where well operations are provisioned from a planner (e.g., a drill planning framework). Such a drilling framework may provide for monitoring and/or control where rendering may be generated to illustrate how well actual drilling parameters follow a planned window. In such an example, the drilling framework may raise one or more alarms and/or notifications responsive to one or more deviations.

As explained, a drive exists toward automation in field operations. To improve acceptance of automation, a drilling framework may include advisory capabilities, that may keep one or more individuals informed as to how well automation is performing. As mentioned, advisory capabilities may also be utilized for purposes of control, for example, as a type of feedback to improve control. As explained, advisory capabilities may include predictive capabilities that may be based at least in part on predictive analytics (e.g., given certain inputs, predictive outputs may be generated). As an example, an automated controller (e.g., an automated control system, etc.) may operate utilizing one or more levels of control, which may include a lower level where a few actions may be automated to an upper level where more actions may be automated. As an example, a framework may include automatically switching from one level to another level of automation based at least in part on predictive analytics and real-time data. In such an example, where a level is transitioned to thereby make a particular action manual rather than automated, a notification may be issued such that a human is in a control loop (e.g., human-in-the-loop (HITL)). In such an example, the framework may provide for generation of one or more recommendations and, for example, assessment of manually implemented control actions with respect to one or more generated recommendations. In such an example, an assessment may be a basis for continuing at the level of automation and/or for changing the level of automation. For example, if the human follows the recommendations closely, that may be a reason to increase automation using the recommendations; whereas, if the human does not follow the recommendations, that may be a reason to maintain the level of automation or to reduce the level of automation as poor recommendations may be an indicator of one or more other issues.

As an example, a drilling framework may include predictive analytics features that may be in the form of a cloud-based application for real-time drilling interpretation. In such an example, the framework may receive data from real-time channels and context data from a rig infrastructure and/or an appropriate server.

As an example, a drilling framework may generate statistics for drilling parameters, for example, in 10 m intervals (e.g., consider a 10 m window, etc.), and may trigger one or more levels of alarm, notifications and/or feedback (e.g., consider medium or high alarm depending on the severity of deviation). As an example, a framework may also provide for procedure adherence indicators for a run or for a well considering overall adherence for a number of parameters. As an example, an ROP value may be in a range from less than one meter per hour to tens of meters per hour. For example, consider an ROP of 10 meters per hour such that an interval (e.g., moving window or segment-by-segment window) of 10 m for statistics may consider data acquired over a period of an hour. As another example, consider an ROP of 30 meters per hour such that an interval (e.g., moving window or segment-by-segment window) of 10 m for statistics may consider data acquired over 20 minutes. As an example, an interval may be dynamic and adjustable, optionally automatically, responsive to ROP. In such an example, an interval may be a time-based window, for example, to adjust an interval length in meters based on a desired time such as, for example, 10 minutes, 20 minutes, 30 minutes, etc.

FIG. 6 shows an example of a table 600 that may be rendered to a display as part of a graphical user interface (GUI). In the table 600, various number positions are indicated (e.g., items 1 to 7) along with corresponding descriptions such as, for example, item 1 as "Wellbore geometry: plot of the current casing and bit depth"; item 2 as "Depth scale with zoom-in: select the depth interval to be visualized"; item 3 as "Lithology: lithology column from drilling operations framework, etc."; item 4 as "Planned operation window: planned min/max threshold for WOB, RPM, Flow rate, and ROP"; item 5 as "Actual drilling parameter statistics: output one statistical bar every 10 m drilling and show percentile details in the tooltip"; item 6 as "Risk indicator and alarm: indicate the alarm status in depth index and time axis" (e.g., accept comments on an alarm by selecting it in time axis); and item 7 as "Parameter indicator: indicate how well the actual drilling parameter fits in the planned window in a run and across the well".

Figure 7:
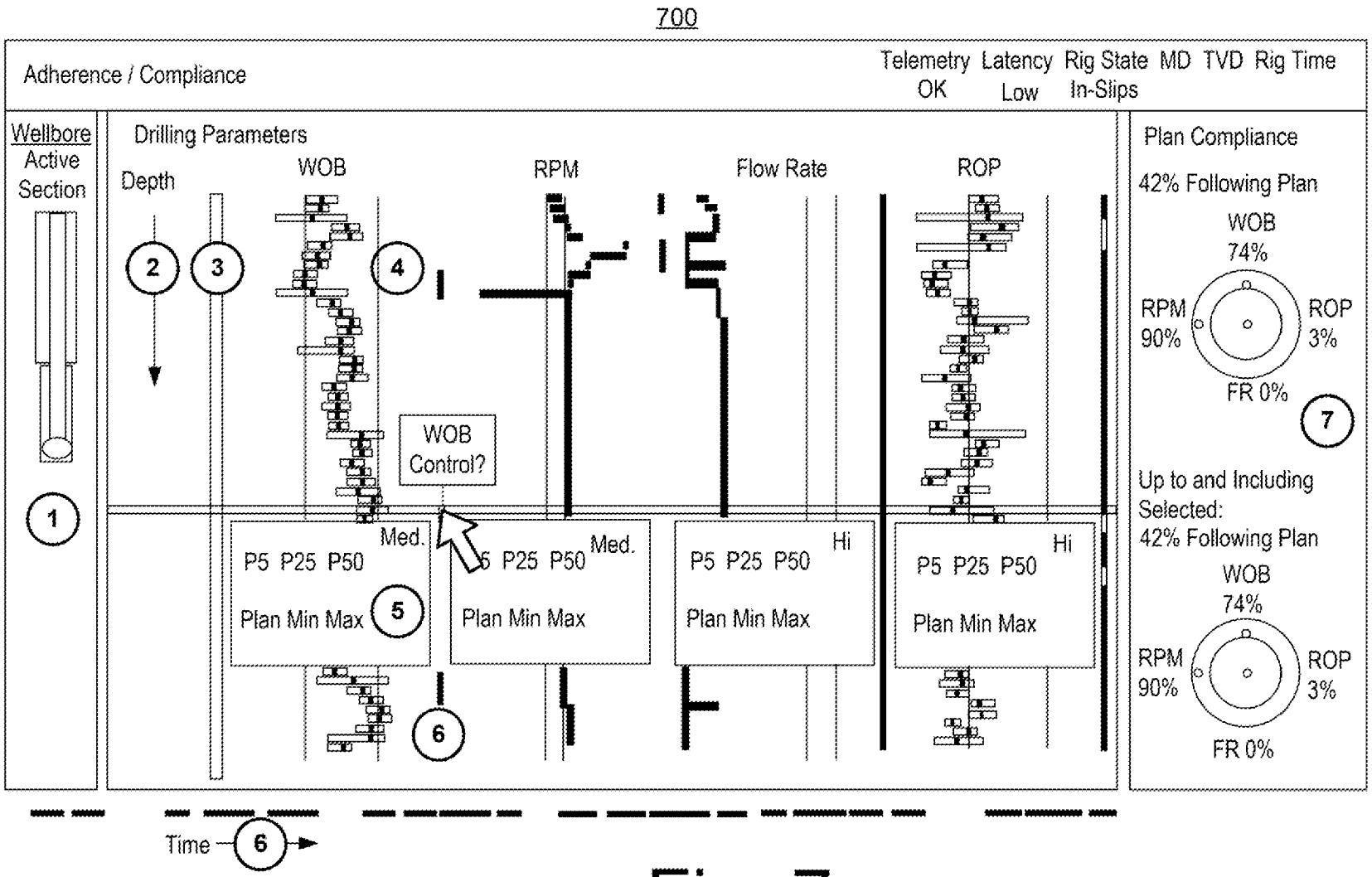
FIG. 7 shows an example of a graphical user interface.

FIG. 7 shows an example graphical user interface (GUI) 700 that includes graphics and graphical controls associated with the items listed in the table 600. As shown with respect to item 7, various plots may be generated and rendered to provide for indications as to how well actual drilling parameters fit a planned window in a run (or runs) and/or across a well or wells. As shown, the GUI 700 may include a graphic of a wellbore with a graphic of a drillstring with a drill bit. As to drilling parameters, as an example, the GUI 700 may include a WOB track, an RPM track, a flow rate (FR) track, a ROP track, etc. In such tracks, various values may be highlighted and/or otherwise rendered, for example, consider P5, P25 and P50 values along with plan minimum and maximum values. As an example, one or more graphics may indicate thresholds such as low, medium or high. Such thresholds may be indicated with respect to depth and/or with respect to time. As shown, various graphics may indicate percentage of following plan for field operations. For example, consider target plots with axes for RPM, WOB, ROP and flow rate (FR). As to the lithology track, shown as item 3, it may include various shadings, graphics, etc., which may correspond to different types of lithology. As an example, by hovering over and/or clicking on the lithology track, information as to the type of lithology may be rendered to a display as part of the GUI 700.

In the example of FIG. 7, the various tracks may include segment-by-segment graphics that may be for an interval specified in meters (e.g., or feet). In such an example, as each interval is drilled, the corresponding graphic may be generated in real-time and may be fixed once that interval is completed. For example, consider commencing a new graphic responsive to completion of a prior interval where the new graphic is dynamically rendered during drilling of a current interval. In such an approach, an operator may visual in real-time statistics and determine how a P50 or other value or indicator changes during drilling of the current interval. In such an example, if the P50 changes substantially, the operator may aim to decrease an interval size to capture statistics on a finer scale.

Figure 11:
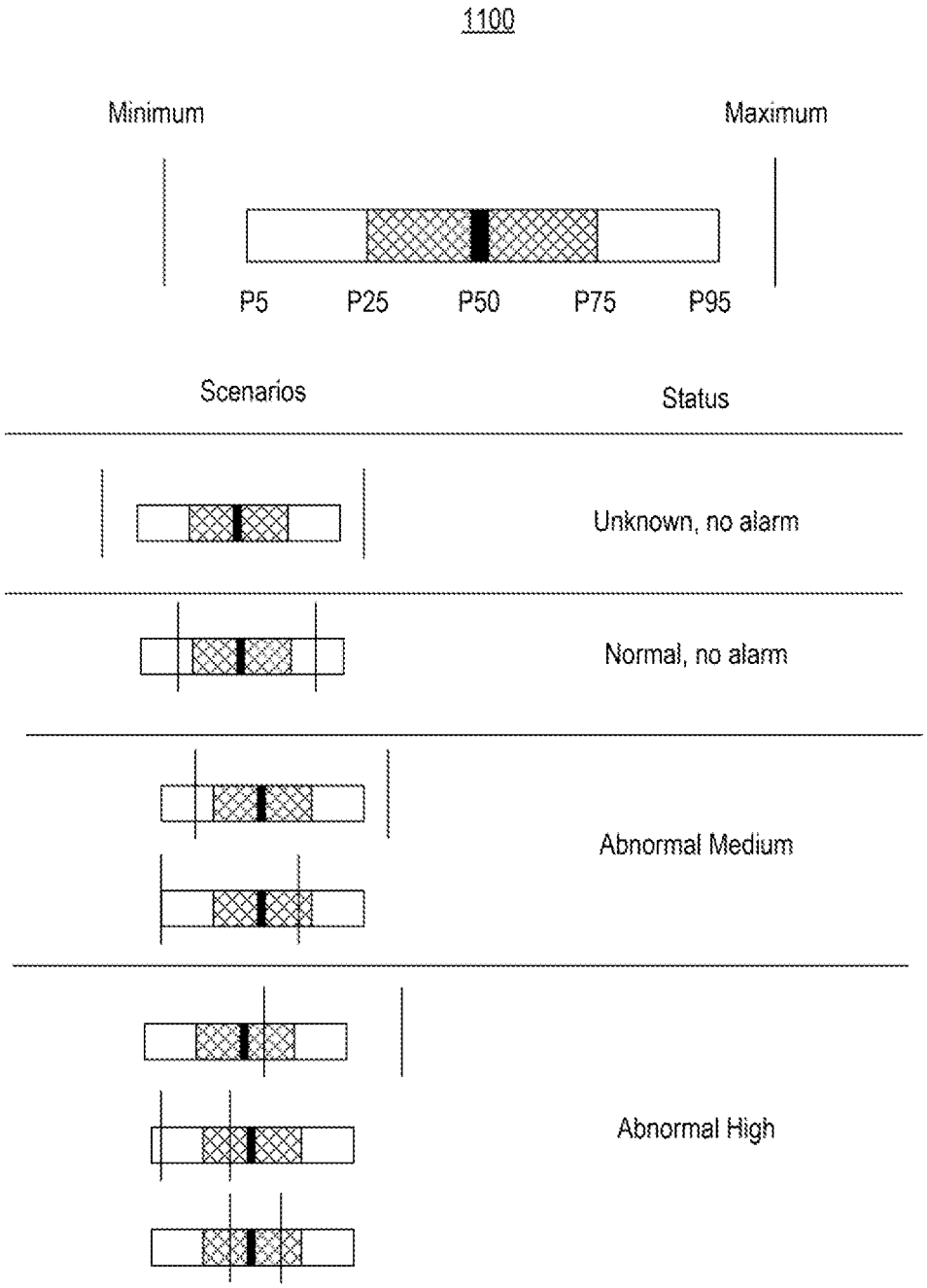
FIG. 11 shows an example of a graphical user interface.

In the example of FIG. 7, the various tracks are shown along with minimum and maximum values with respect to measured depth. Such values may be utilized to determine one or more actions, which may include one or more issuance actions as to issuance of a notification, a control signal, etc. As an example, an assessment technique may be utilized for generation of one or more notifications, graphics, control recommendations, control signals, etc. For example, FIG. 11 shows graphically some examples of techniques that may be utilized to determine unknown, normal, abnormal medium and abnormal high indicators, which may be a basis for rendering of one or more graphical indicators in a GUI such as the GUI 700 of FIG. 7 with respect to time, with respect to measured depth, with respect to true vertical depth, etc.

In the example of FIG. 7, an operator may navigate the GUI 700, for example, using a pointing device or another human input device, to select one or more intervals (e.g., one or more depth-based windows, etc.). In such an example, consider hovering over or clicking on a warning track that may indicate a deviation (e.g., medium, high, etc.) such that graphics are generated and rendered that may provide particular numeric values such as, for example, numeric values for P5, P25, P50, etc., along with, for example, a plan value, a minimum value and a maximum value. In such an example, graphics may be generated for a single track or for multiple tracks (see, e.g., horizontal box). In such an example, the graphics may correspond to a depth interval (e.g., measured depth interval) where values are rendered for one or more of the drilling parameters, optionally along with one or more indicators of lithology. As explained, a time-based warning track may be rendered where, for example, upon actuation of either a depth-based warning track or a time-based warning track, one or more graphics may provide for a correspondence between the two. For example, consider highlighting a portion of a time-based warning track upon selection of a portion of a depth-based warning track or vice versa. In such an approach, time and depth may be immediately related in the GUI 700. As shown in the example of FIG. 7, a graphic may be rendered for control action. For example, consider an operator clicking on a portion of a warning track for the WOB drilling parameter where a graphic may be rendered for WOB control. In such an example, depending on level of automation of control, the operator may have to actuate a graphical tool to cause issuance of one or more control signals to cause a wellsite system to effectuate equipment control. At a more automated level, a control signal may be issued automatically for implementation by a wellsite system. As an example, upon clicking on a warning track, the GUI 700 may render a graphic that indicates an actual and/or a recommended control action (e.g., as may occur responsive to a warning being an elevated warning that may operate as a trigger).

As an example, a wellbore graphic may remain synchronized to an actual drilling location (e.g., not necessarily scaled to the depth track) and/or may dynamically change upon selection of a graphic to a state that corresponds to the depth and/or time associated with the selected graphic.

As an example, a plan compliance graphic may be dynamically linked to a selected graphic, for example, to indicate plan compliance for the selected graphic, for drilling up to and including the selected graphic, etc. Accordingly, the GUI 700 may provide various features for interactions to increase awareness of drilling, whether for a current time or one or more past times. As explained, the GUI 700 may be linked to one or more generators for control, which may provide for control recommendation and/or control implementation that may aim to increase plan compliance, if warranted, or, for example, for plan regeneration (e.g., re-planning, etc.), if warranted. As an example, if plan compliance drops below a threshold for a number of intervals, a framework may call for re-planning; whereas, if plan compliance may be increased responsive to issuance of one or more control signals, the framework may continue to operate in an effort to increase plan compliance without calling for re-planning.

As shown in the example of FIG. 7, the GUI 700 may provide for rendering of one or more other types of information such as, for example, telemetry information, latency information, rig state (see, e.g., in-slips), measured depth (MD), total vertical depth (TVD), rig time, etc. In such an example, if telemetry information and/or latency information indicate one or more issues, an operator may understand that there may be an issue with respect to one or more of the drilling parameter tracks and adjust expectations accordingly. As an example, a graphic may be rendered to one or more tracks that indicate a data-related issue such that an operator understands that reliable statistics may not be available for an interval. As an example, a plan compliance graphic may include an indicator as to statistics availability. For example, consider an indicator that indicates a percentage of intervals for which reliable data and/or statistics have been generated. In such an example, if the percentage is low, an operator may focus more on plan compliance on an interval-by-interval basis for intervals with reliable data and/or statistics rather than an overall basis. In such an example, one or more recommendations may be generated as to improving reliability of data and/or statistics for one or more drilling parameters (e.g., check data interface for sensor X, etc.).

As explained, a framework may provide for generation of statistical results in real-time where such results may be rendered to one or more displays. As explained, statistical results may be generated for a distance-based interval and/or for a time-based interval. Statistical results may be rendered as graphics in a regular manner and may be a basis for indicating one or more conditions (e.g., unknown, normal, abnormal, etc.). In such an example, renderings based on statistical results may provide for assessment of field operations in real-time with respect to one or more plans for the field operations. As explained, a framework may provide for generating output as to plan compliance where such a framework may also provide for issuance of one or more of notifications and control recommendations (e.g., for manual and/or automated implementation, etc.).

As an example, a drilling framework may provide for measuring flowrate compliance (e.g., during a drilling operation). In such an example, flowrate may correspond to drilling fluid flowrate (e.g., or flow rate), which may serve one or more purposes. Drilling fluid may lubricate a drill bit, carry away cuttings, provide for mud-pulse telemetry, provide for appropriate force with respect to formation fluids, drive a mud-motor, etc. Flowrate of drilling fluid may be controlled using surface equipment such as, for example, one or more pumps. As explained, surface equipment may provide for recirculating mud where mud is processed to remove cutting and, for example, adjusted to appropriate property values (e.g., mud weight, etc.).

As an example, a drilling framework may provide output for noncompliance that may be caused by a planned window change or, for example, by a real-time drilling data change. As an example, a framework may provide for summarized indicators of a run and/or a well compliance score, which may be readily compared on a run-to-run basis and/or well to well basis (e.g., in terms of drilling parameters compliance).

As an example, a drilling framework may be dynamic such that attention to a display or displays may be periodic, for example, responsive to output from predictive analytics (e.g., consider alarm and/or notification functionality to warn an individual when non-compliance occurs).

As explained, predictive analytics may provide for compliance checks on operations involving flowrate and, for example, may provide for generation of a dashboard with an overall graphical view to show wellbore geometry (WBG), lithology and related planned operation window, together with real-time drilling parameter statistics. Such a dashboard may have a layout that makes it easy to see changes in a plan and/or operation. As mentioned, predictive analytics may provide well and run level summarized compliance scores, which may be compared between runs and wells.

Figure 8:
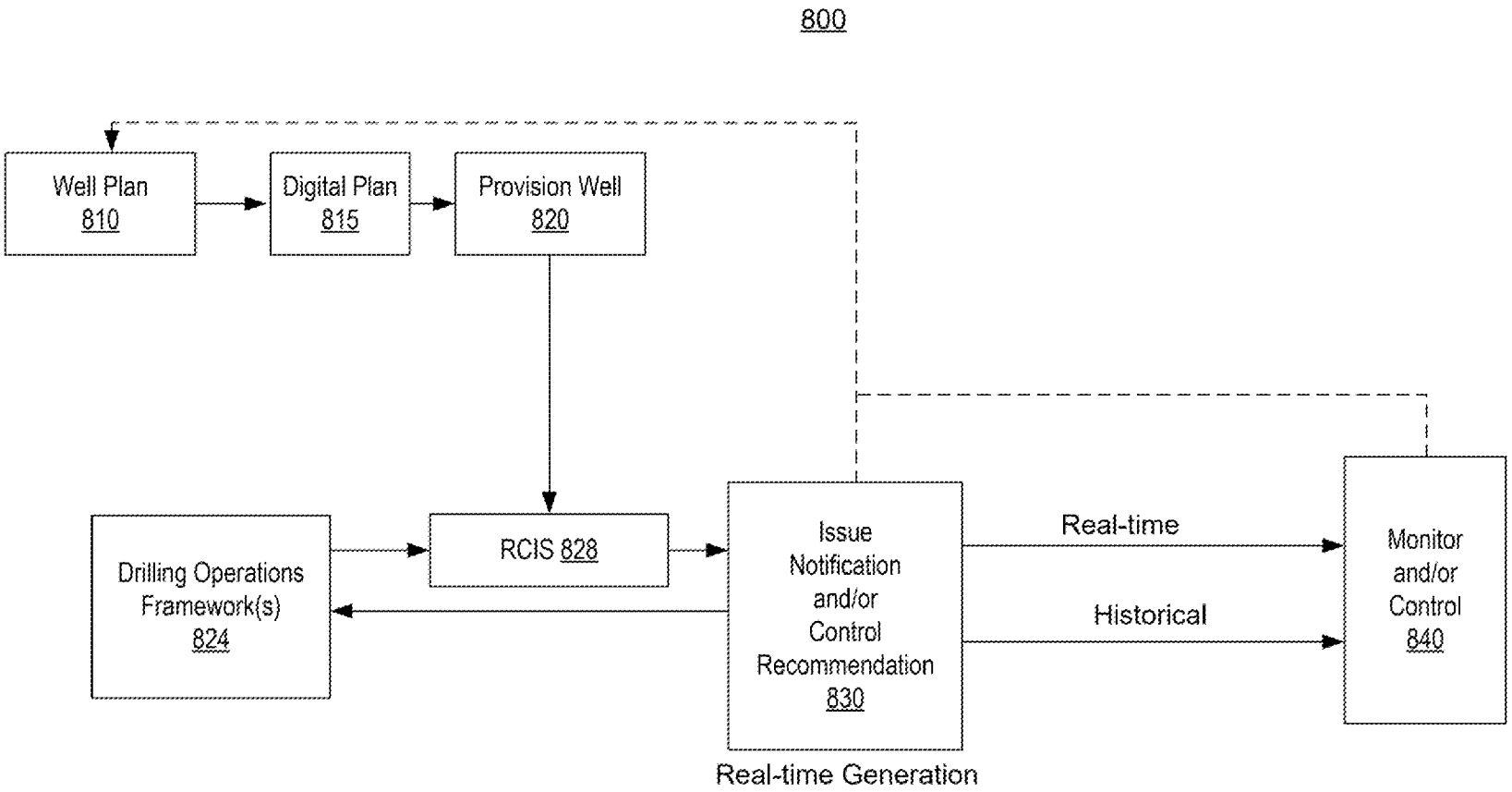
FIG. 8 shows an example of a workflow.

FIG. 8 shows an example of a workflow 800 with various blocks that may representation actions where the blocks include a well plan block 810, a provision well block 820, an issuance block 830 and a monitor and/or control block 840. Also shown are a digital plan block 815, a drilling operations framework(s) block 824 and a rig control and information system (RCIS) block 828. As to an action of the block 810, a well plan may be generated and accessed. For example, in a well plan phase, a workflow may provision a well with a DDP including planned drilling parameters (e.g., depth-based surface RPM, surface WOB, flowrate and ROP) in a drill planning project. In such an example, the planned drilling parameters (e.g., with min, max and recommended values) may be stored in the project and encapsulated as DDP. Though DDP may be used as source for planned drilling parameters in an implemented workflow, planned drilling parameters may be from one or more sources and, for example, streamed into a system with a BHA Run WITSML object.

As shown in the example of FIG. 8, the workflow 800 may include the well plan block 810, the provision well (or well provisioning) block 820, the issuance block 830 for issuance of a notification and/or control generating action (e.g., a control recommendation, etc.), and the monitor and/or control block 840 for monitoring and/or controlling one or more field operations, field conditions, etc. As shown, the workflow 800 may operate to generate real-time outputs responsive to real-time field operational data. In the example of FIG. 8, the workflow may implement one or more frameworks such as, for example, a well plan generation framework, a field operations framework, etc.

As an example, the workflow 800 of FIG. 8 may include rendering of one or more GUIs and may include operating responsive to one or more GUI-based interactions. As explained, a framework may operate to improve plan compliance and/or to call for re-planning, as appropriate. As an example, such a framework may provide for initiating one or more loops within the workflow 800. For example, as to re-planning, consider generation of a new or revised digital plan per the well plan block 810 such that the new or revised digital plan per the block 815 is automatically provisioned by the provision well block 820 for implementation by the RCIS 828. In such an example, a GUI such as the GUI 700 may be rendered with one or more graphics that indicate re-planning and implementation of a new or revised digital plan, which may provide for generation of new values for one or more tracks, etc. (e.g., one or more new minima, one or more new maxima, etc.). In such an example, a new or revised digital plan compliance graphic may be generated and rendered such that plan compliance under the prior plan and the current plan may be compared (e.g., to assess the new or revised digital plan and/or implementation thereof).

Figure 9:
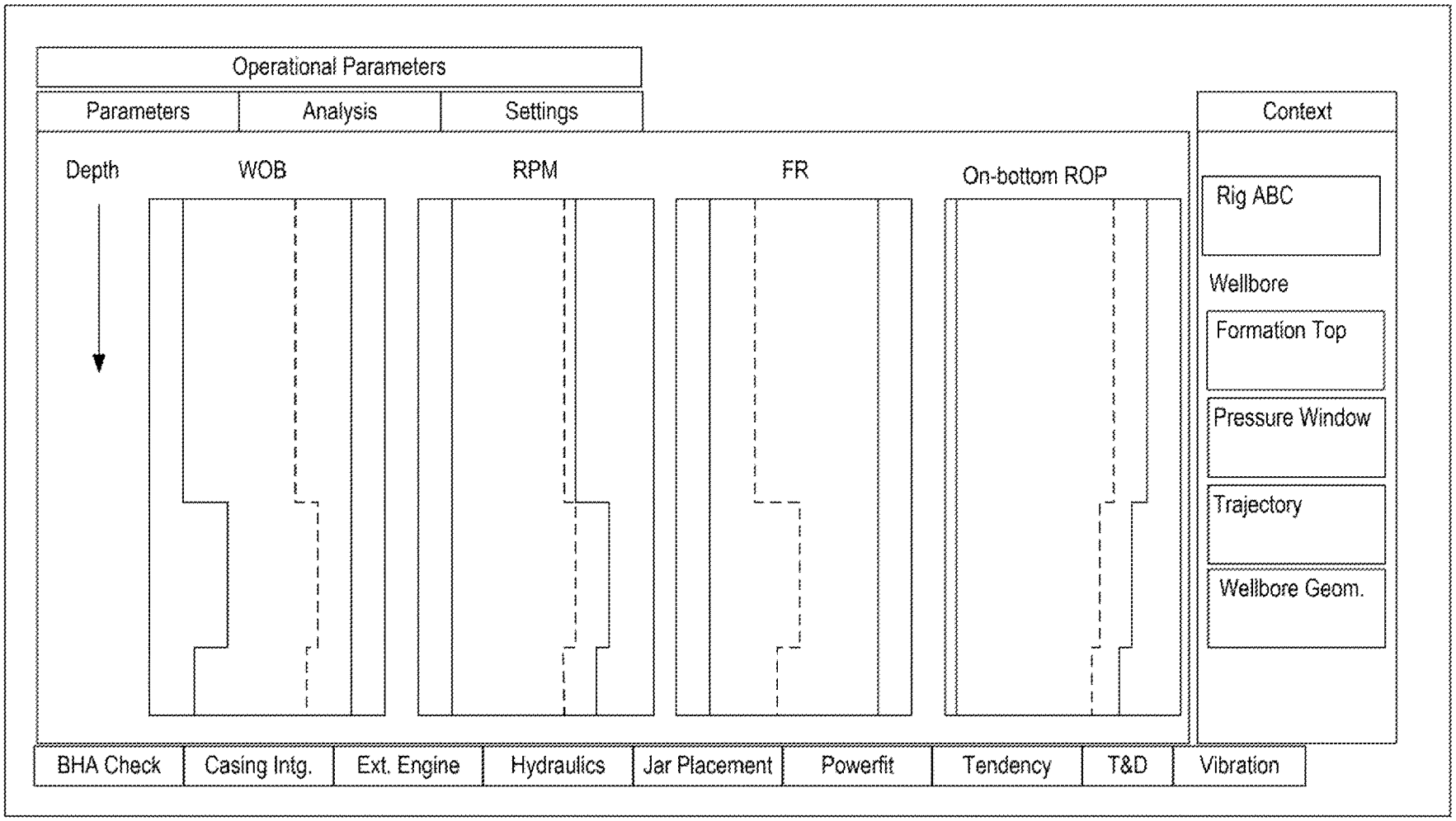
FIG. 9 shows an example of a graphical user interface.

FIG. 9 shows an example of a GUI 900 that may be utilized for the workflow 800 of FIG. 8. As explained, the workflow 800 may include provisioning per the provision well block 820 where a user may utilize a created well plan per the well plan block 810 as may be stored in a cloud hosted platform accessible via a landing portal where the user may then select a DDP name for a DDP, which includes the planned drilling parameters that will be extracted and distributed for purposes of real-time computations for a provisioned well. In the GUI 900, various operational parameters (e.g., drilling parameters) are shown with respect to depth where the parameters may include WOB, RPM, flow rate (FR) and on-bottom ROP. In such an example, the operational parameters may be presented as values for minimum, maximum and recommended, where recommended values may be bound by the minimum and the maximum values which may vary with respect to depth (e.g., measured depth). As shown, the GUI 900 may be utilized for one or more purposes, which may include selection of one or more tabs for aspects of drilling equipment, drilling operations, etc.

As an example, the GUI 900 may be generated as a pre-run GUI that may be populated with generated graphics in real-time during performance of one or more field operations. For example, consider the GUI 700 of FIG. 7 where the various graphics indicating statistical results may be rendered with respect to time as drilling occurs to extend a borehole in a subsurface region. As explained, such an approach may provide for a statistics-based understanding of compliance with a plan along with, for example, control of one or more field operations (e.g., responsive to one or more deviations from a plan, etc.). As explained, one or more levels of automation may be utilized where statistical results may provide for control of level of automation selected for performance of one or more field operations.

Figure 10:
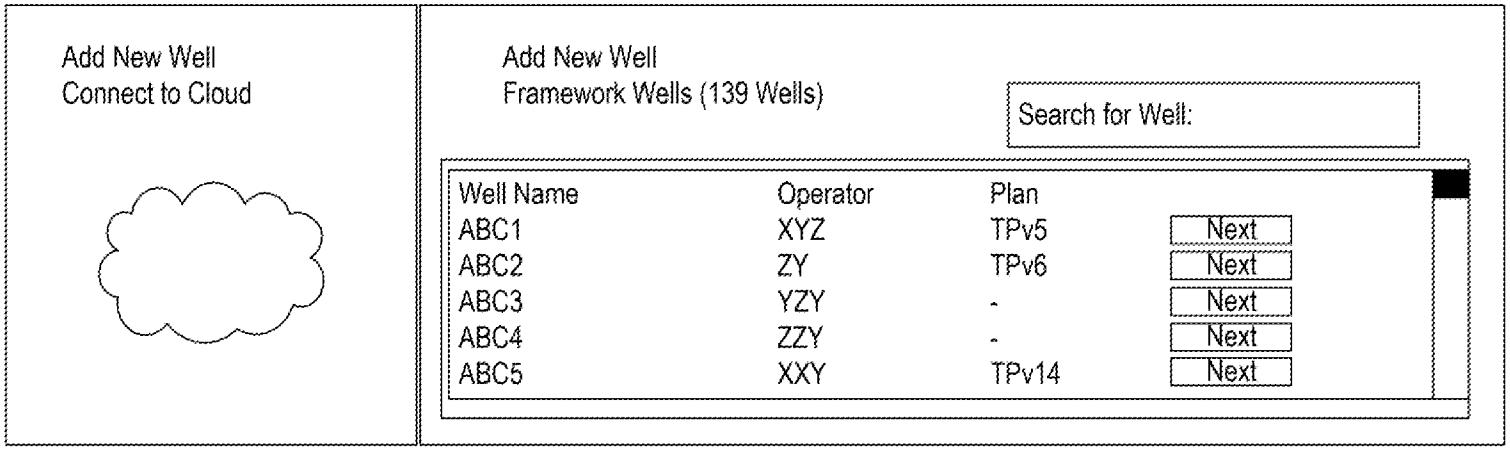
FIG. 10 shows an example of a graphical user interface.

FIG. 10 shows an example of a GUI 1000 that may correspond to the provision block 820 of the workflow 800 of FIG. 8, for example, to provision a well from a plan project (e.g., a digital well plan). As shown, the GUI 1000 may include various options such as a connect to cloud option and a table-based option, which may be operatively coupled to a framework, a database, etc. As an example, once a well is selected for provisioning, one or more alarms, notifications, control actions, may be generated. For example, consider a statistical distribution of the parameters with percentiles (e.g., P5, P25, P50, P75, P95, etc.) that may be summarized within every 10 meters of drilling distance (e.g., a distance interval) and output in real-time. As mentioned, an interval may be defined automatically, by a user, etc. As an example, an interval may be defined in a manner that balances frequency and/or resolution and ROP (e.g., distance drilled within a period of time, etc.).

As an example, a drilling framework may provide for generating output as to how well actual drilling parameters follow a planned window where the framework may generate alarms, notifications, and/or control signals. For example, consider the following logic: (a) no alarm if there is no planned reference or less than 25% data is below the planned minimum threshold or above the planned maximum threshold; (b) medium alarm is triggered when 25% to 50% data is below the planned minimum threshold or above the planned maximum threshold; and (c) high alarm is triggered when more than 50% data is below the planned minimum threshold or above the planned maximum threshold. As an example, it may also be triggered when more than 25% data is below the planned minimum threshold and another 25% data is above the planned maximum threshold; noting that one or more other values may be utilized as percentages, etc.

FIG. 11 shows an example of a GUI 1100 with various types of outputs that may be statistically based, for example, using probabilities (e.g., P5, P25, P50, P75 and P95). In the example GUI 1100 of FIG. 11, minimum and maximum values are also indicated using graphics, which may be utilized in performing one or more assessments, making one or more determinations, generating one or more additional graphics, etc. As an example, the probabilities may be generated using minimum and/or maximum values.

As shown in FIG. 11, various scenarios may be included in the GUI 1100 along with corresponding statuses (e.g., unknown, no alarm; normal, no alarm; abnormal medium; and abnormal high). As an example, one or more of the scenarios may be adjustable. For example, a user may provide for adjustment of P-levels, bounds for known, unknown, normal, abnormal, medium, high, etc. In the example of FIG. 11, the various scenarios may be associated with graphics and positioning of graphics that may provide an operator with a clear visual indication as to one or more underlying types of issues that may be occurring. As to the normal scenario, P5 and P95 are within the minimum and maximum values. As to the normal, no alarm scenario, the P5 and P95 are outside of the minimum and maximum values while the P25 and P75 are within. As to the abnormal medium scenario, it may depend on an asymmetry with respect to minimum and maximum values and/or one of such values being within a P25 to P50 zone (e.g., minimum) or P50 to P75 zone (e.g., maximum). As to the abnormal high scenario, it may correspond to both minimum and maximum values being in a P25 to P75 zone, a minimum value being in a P50 to P75 zone, or a maximum value being in a P25 to P50 zone. As explained, such types of graphics may provide for a heightened level of understanding when rendered to a display and/or may provide a basis for issuance of one or more notifications, control signals, etc.

As an example, various graphics in the example tracks of the GUI 700 of FIG. 7 may be generated in accordance with a scheme such as the scheme illustrated with respect to the example GUI 1100. As explained, the GUI 700 includes tracks with maximum and minimum values with respect to depth, which may, for example, be generated as in the example GUI 900 of FIG. 9, where, for example, during field operations, real-time graphics may be generated and rendered to a display based statistical results for real-time data. As explained, one or more graphics may be dynamic, for example, during an interval and then, for example, may become fixed.

As explained, a drilling framework may generate compliance indicators for a current BHA run and/or for an entire well. In such an example, a value may indicate how well an actual parameter follows a plan in run and well scope. By counting the number of each 10-meters depth interval with different status, the value may be computed to equal the ratio of the count of intervals with normal status to the count of intervals with known status. As explained, there may be indicators calculated for each specific parameter (e.g., surface WOB, surface RPM, ROP and flowrate), and an overall indicator may be computed by taking the multiple parameters into consideration.

As to monitoring, a drilling framework may provide intuitive plots that are readily viewed such that actual drilling parameters may be discerned within the context of a plan window (e.g., for purposes of plan to execution comparisons). As an example, alarms and notifications may be automated, for example, to pop up to attract a user's attention when a deviation is occurring for one or more parameters. As explained, a control action may be taken responsive to a deviation where, for example, the control action may depend on one or more of type of parameter, magnitude of deviation, trend of deviation, deviation history, etc.

As explained, a workflow for tracking drilling parameters adherence to a plan in real-time may include loading a depth-based window of planned drilling parameters for a well, calculating statistical distributions of the actual drilling parameters according to one or more drilling footage (e.g., 10 meters) intervals from streamed channel data. In such an example, the workflow may include reporting alarms and/or notifications, for example, based on comparisons of a parameter distribution with a planned window. As an example, a workflow may include calculating a compliance indicator for each parameter and summarizing to an overall indicator, for example, for a current BHA run and/or one or more portions of a well. In such an example, indicators may be displayed in real-time. As an example, a workflow may include rendering to a display a planned window versus actual statistics of each parameter in a depth-based chart. In such an example, actual statistics of each parameter may be displayed as a bar with percentiles (e.g., rendered responsive to a mouse hover) where percentiles may include, for example, one or more of P5, P25, P50, P75, and P95. As an example, a workflow may include rendering to a display WBG and lithology, for example, in a depth-based chart. As an example, alarm indicators may be rendered to a display, which may be in combination with a depth-based chart and/or a time-based chart.

FIG. 12 shows an example of a method 1200 and an example of a system 1290. As shown, the method 1200 may include a reception block 1210 for receiving a digital well plan that specifies planned drilling parameters for drilling a borehole, where each of the specified planned drilling parameters includes one or more of a minimum threshold and a maximum threshold; a generation block 1220 for generating statistical distributions of actual drilling parameters in real-time responsive to receipt of real-time data acquired during a depth-based window for the drilling; a generation block 1230 for generating comparisons in real-time, where each of the comparisons is between one of the statistical distributions and a corresponding one of the planned drilling parameters for the depth-based window; and an issuance block 1240 for, responsive to one or more of the comparisons indicating an unacceptable actual to planned parameter deviation, issuing a control signal.

FIG. 12 also shows various computer-readable media (CRM) blocks 1211, 1221, 1231, and 1241. Such blocks may include instructions that are executable by one or more processors, which may be one or more processors of a computational framework, a system, a computer, etc. A computer-readable medium may be a computer-readable storage medium that is not a signal, not a carrier wave and that is non-transitory. For example, a computer-readable medium may be a physical memory component that may store information in a digital format.

In the example of FIG. 12, a system 1290 includes one or more information storage devices 1291, one or more computers 1292, one or more networks 1295 and instructions 1296. As to the one or more computers 1292, each computer may include one or more processors (e.g., or processing cores) 1293 and memory 1294 for storing the instructions 1296, for example, executable by at least one of the one or more processors. As an example, a computer may include one or more network interfaces (e.g., wired or wireless), one or more graphics cards, a display interface (e.g., wired or wireless), etc. The system 1290 may be specially configured to perform one or more portions of the method 1200 of FIG. 12.

As an example, a computational framework may include a solver, which may be implemented via executable instructions. For example, consider a computational framework that includes a processor and memory accessible to the processor where executable instructions may be stored in the memory and accessed for execution by the processor to cause the computational framework to perform one or more actions. Such a computational framework may include one or more interfaces for receipt of information and/or for output of information, which may include values of parameters, an instruction, etc. As an example, a computational framework may be part of a controller. As an example, a computational framework may be part of a system.

As an example, various systems, methods, etc., may implement one or more ML models. As to types of ML models, consider one or more of a support vector machine (SVM) model, a k-nearest neighbors (KNN) model, an ensemble classifier model, a neural network (NN) model, etc. As an example, a machine learning model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a system may utilize one or more recurrent neural networks (RNNs). One type of RNN is referred to as long short-term memory (LSTM), which may be a unit or component (e.g., of one or more units) that may be in a layer or layers. A LSTM component may be a type of artificial neural network (ANN) designed to recognize patterns in sequences of data, such as time series data. When provided with time series data, LSTMs take time and sequence into account such that an LSTM may include a temporal dimension. For example, consider utilization of one or more RNNs for processing temporal data from one or more sources, optionally in combination with spatial data. Such an approach may recognize temporal patterns, which may be utilized for making predictions (e.g., as to a pattern or patterns for future times, etc.).

As an example, the TENSORFLOW framework (Google LLC, Mountain View, California) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As mentioned, a framework such as the PYTORCH framework may be utilized.

As an example, a training method may include various actions that may operate on a dataset to train a ML model. As an example, a dataset may be split into training data and test data where test data may provide for evaluation. A method may include cross-validation of parameters and best parameters, which may be provided for model training.

The TENSORFLOW framework may run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, a method may include receiving a digital well plan that specifies planned drilling parameters for drilling a borehole, where each of the specified planned drilling parameters includes a minimum threshold and a maximum threshold; generating statistical distributions of actual drilling parameters in real-time responsive to receipt of real-time data acquired during a depth-based window for the drilling; generating comparisons in real-time, where each of the comparisons is between one of the statistical distributions and a corresponding one of the planned drilling parameters for the depth-based window; and, responsive to one or more of the comparisons indicating an unacceptable actual to planned parameter deviation, issuing a control signal. In such an example, the drilling parameters may include one or more of surface weight on bit, surface revolutions per unit time, rate of penetration and drilling fluid flowrate.

As an example, a depth-based window may be greater than 0.1 meter and less than 100 meters. For example, consider a depth-based window that is approximately 10 meters. As an example, a depth-based window may be a measured depth-based window (e.g., utilizing measured depth as a metric). As explained, a measured depth (MD) may be measured along a length of a borehole (e.g., a wellbore). As an example, a depth-based window may be a true vertical depth-based window (e.g., a TVD-based window). As explained, a window may be an interval and, for example, an interval may be a window.

As an example, a method may include determining percentile values for each of a number of statistical distributions. In such an example, an unacceptable actual to planned parameter deviation may depends on a minimum threshold for one of a number of planned drilling parameters and/or an unacceptable actual to planned parameter deviation may depend on a maximum threshold for one of the number of planned drilling parameters.

As an example, a control signal may be selected from a group of control signals. In such an example, the group of control signals may be classified according to levels. For example, consider levels that are based on predetermined percentages defined with respect to specified minimum thresholds and specified maximum thresholds of planned drilling parameters.

As an example, a control signal may be or include a surface equipment control signal for controlling surface equipment for drilling the borehole and/or a control signal may be or include a downhole equipment control signal for controlling downhole equipment for drilling the borehole.

As an example, a method may include generating a graphical user interface and updating the graphical user interface in real-time responsive to generating statistical distributions of actual drilling parameters in real-time.

As an example, a method may include generating one or more compliance indicators for compliance with a digital well plan. In such an example, the method may include, responsive to one of the one or more compliance indicators indicating a deviation from the digital well plan, calling, in real-time, for re-planning of the digital well plan (e.g., using a planning engine of a planning framework, etc.). As an example, one or more compliance indicators may include one or more of a BHA run compliance indicator and an entire well compliance indicator. In such an example, a method may include comparing at least one of the one or more compliance indicators to a historical compliance indicator and, responsive to an unacceptable comparison, calling, in real-time, for control of a drilling to improve compliance.

As an example, an unacceptable actual to planned parameter deviation may correspond to an unacceptable deviation in a drilling fluid flowrate, where, for example, a control signal may be or include a drilling fluid subsystem control signal.

As an example, a system may include one or more processors; memory accessible to at least one of the one or more processors; processor-executable instructions stored in the memory and executable to instruct the system to: receive a digital well plan that specifies planned drilling parameters for drilling a borehole, where each of the specified planned drilling parameters includes one or more of a minimum threshold and a maximum threshold; generate statistical distributions of actual drilling parameters in real-time responsive to receipt of real-time data acquired during a depth-based window for the drilling; generate comparisons in real-time, where each of the comparisons is between one of the statistical distributions and a corresponding one of the planned drilling parameters for the depth-based window; and, responsive to one or more of the comparisons indicating an unacceptable actual to planned parameter deviation, issue a control signal.

As an example, one or more computer-readable storage media may include processor-executable instructions to instruct a computing system to: receive a digital well plan that specifies planned drilling parameters for drilling a borehole, where each of the specified planned drilling parameters includes one or more of a minimum threshold and a maximum threshold; generate statistical distributions of actual drilling parameters in real-time responsive to receipt of real-time data acquired during a depth-based window for the drilling; generate comparisons in real-time, where each of the comparisons is between one of the statistical distributions and a corresponding one of the planned drilling parameters for the depth-based window; and, responsive to one or more of the comparisons indicating an unacceptable actual to planned parameter deviation, issue a control signal.

As an example, a computer program product that may include computer-executable instructions to instruct a computing system to perform one or more methods such as one or more of the methods described herein (e.g., in part, in whole and/or in various combinations).

Figure 13:
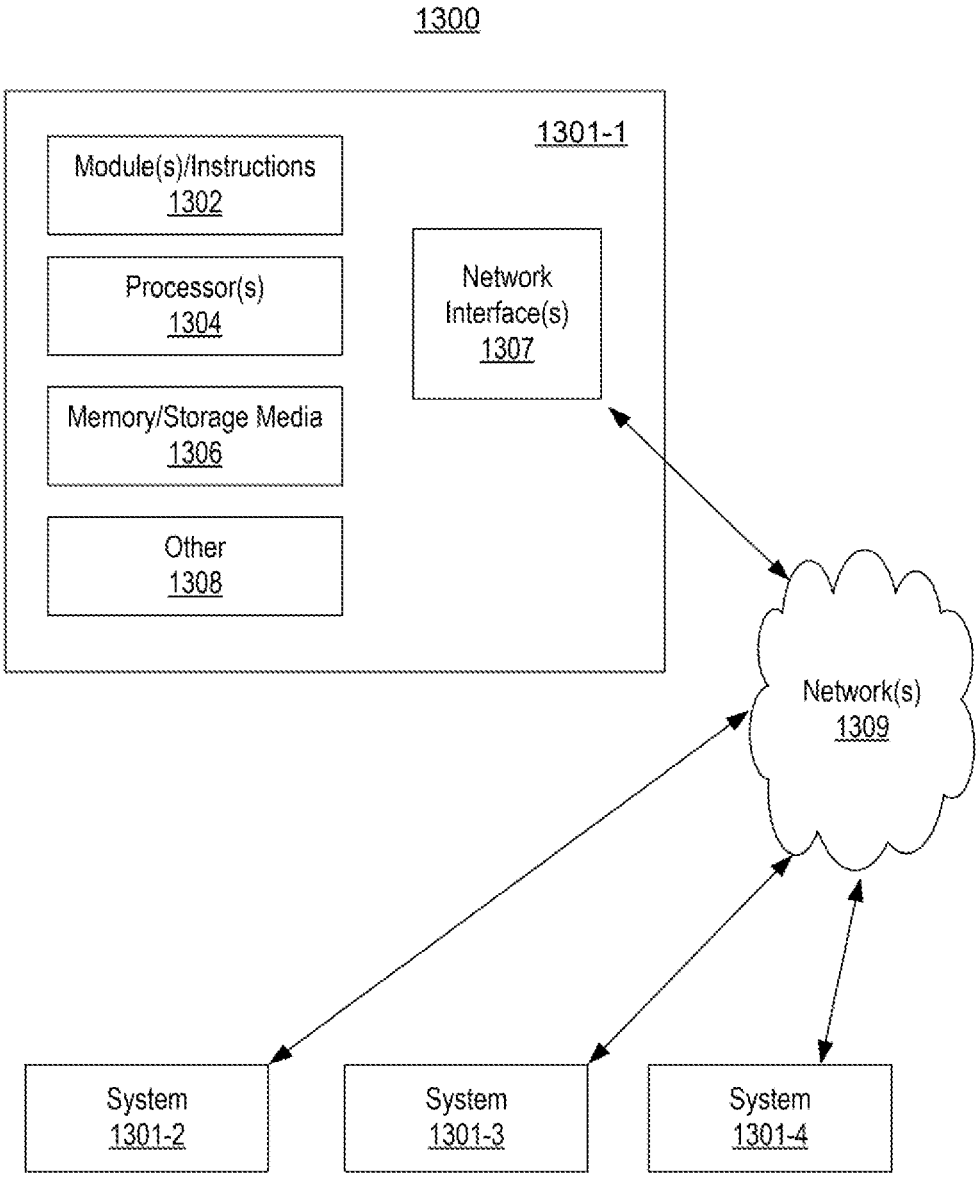
FIG. 13 shows an example of a system.

In some embodiments, a method or methods may be executed by a computing system. FIG. 13 shows an example of a system 1300 that may include one or more computing systems 1301-1, 1301-2, 1301-3 and 1301-4, which may be operatively coupled via one or more networks 1309, which may include wired and/or wireless networks.

As an example, a system may include an individual computer system or an arrangement of distributed computer systems. In the example of FIG. 13, the computer system 1301-1 may include one or more modules 1302, which may be or include processor-executable instructions, for example, executable to perform various tasks (e.g., receiving information, requesting information, processing information, simulation, outputting information, etc.).

As an example, a module may be executed independently, or in coordination with, one or more processors 1304, which is (or are) operatively coupled to one or more storage media 1306 (e.g., via wire, wirelessly, etc.). As an example, one or more of the one or more processors 1304 may be operatively coupled to at least one of one or more network interface 1307. In such an example, the computer system 1301-1 may transmit and/or receive information, for example, via the one or more networks 1309 (e.g., consider one or more of the Internet, a private network, a cellular network, a satellite network, etc.). As shown, one or more other components 1308 may be included in the computer system 1301-1.

As an example, the computer system 1301-1 may receive from and/or transmit information to one or more other devices, which may be or include, for example, one or more of the computer systems 1301-2, etc. A device may be located in a physical location that differs from that of the computer system 1301-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1306 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that may be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method, comprising:

receiving, by a computing system, a digital well plan that specifies planned drilling parameters for drilling a borehole, each of the specified planned drilling parameters comprising one or more of a minimum threshold and a maximum threshold;

generating, by the computing system, statistical distributions of actual drilling parameters in real-time responsive to receipt of real-time data acquired during a depth-based window for the drilling, the depth-based window being dynamic and automatically adjustable responsive to rate of penetration for the drilling;

generating, by the computing system, comparisons in real-time, each of the comparisons being between one of the statistical distributions and a corresponding one of the planned drilling parameters for the depth-based window;

generating a graphical user interface (GUI) comprising a plurality of tracks respectively corresponding to the generated comparisons, each of the plurality of tracks displaying:

a P5 mark indicating a 5% deviation of the actual drilling parameters from the planned drilling parameters;

a P25 mark indicating a 25% deviation of the actual drilling parameters from the planned drilling parameters;

a P50 mark indicating a 50% deviation of the actual drilling parameters from the planned drilling parameters;

a P75 mark indicating a 75% deviation of the actual drilling parameters from the planned drilling parameters;

a P95 mark indicating a 95% deviation of the actual drilling parameters from the planned drilling parameters;

updating the graphical user interface in real-time responsive to the generating statistical distributions of the actual drilling parameters in real-time;

determining, based on the comparisons, that an actual to planned parameter deviation is unacceptable;

issuing, by the computing system, a control signal in response to the determination that the actual to planned parameter deviation is unacceptable, the control signal comprising a surface equipment control signal for controlling surface equipment for drilling the borehole or a downhole equipment control signal for controlling downhole equipment for drilling the borehole; and controlling the surface equipment or the downhole equipment to control a bottom hole assembly (BHA) to switch between a sliding mode and a rotating mode according to the control signal to return the actual to planned parameter deviation to an acceptable range.

2. The method of claim 1, wherein the planned and actual drilling parameters comprise one or more of: surface weight on bit, surface revolutions per unit time, rate of penetration, or drilling fluid flowrate.

3. The method of claim 1, wherein the depth-based window is greater than 0.1 meter and less than 100 meters.

4. The method of claim 3, wherein the depth-based window is 10 meters.

5. The method of claim 1, further comprising determining percentile values for each of the statistical distributions.

6. The method of claim 5, wherein the unacceptable actual to planned parameter deviation depends on the minimum threshold for one of the planned drilling parameters.

7. The method of claim 5, wherein the unacceptable actual to planned parameter deviation depends on the maximum threshold for one of the planned drilling parameters.

8. The method of claim 1, wherein the control signal is selected from a group of control signals.

9. The method of claim 8, wherein the group of control signals is classified according to levels.

10. The method of claim 9, wherein the levels are based on predetermined percentages defined with respect to specified minimum thresholds and specified maximum thresholds of the planned drilling parameters.

11. The method of claim 1, further comprising generating one or more compliance indicators for compliance with the digital well plan.

12. The method of claim 11, further comprising, responsive to one of the one or more compliance indicators indicating a deviation from the digital well plan, calling, in real-time, for re-planning of the digital well plan.

13. The method of claim 11, wherein the one or more compliance indicators comprise one or more of a BHA run compliance indicator and an entire well compliance indicator.

14. The method of claim 13, further comprising comparing at least one of the one or more compliance indicators to a historical compliance indicator and, responsive to an unacceptable comparison, calling, in real-time, for control of the drilling to improve compliance.

15. The method of claim 1, wherein the unacceptable actual to planned parameter deviation corresponds to an unacceptable deviation in a drilling fluid flowrate, the control signal comprises a drilling fluid subsystem control signal.

16. The method of claim 1, wherein:

the determining that an actual to planned parameter deviation is unacceptable is further based on determining a status of the actual drilling parameters, the status comprising one or more of:

a first scenario corresponding to a normal scenario in which P5 and P95 are within the minimum threshold and the maximum threshold;

a second scenario corresponding to a normal, no alarm scenario in which P5 and P95 are outside of the minimum threshold and the maximum threshold while P25 and P75 are within the minimum threshold and the maximum threshold;

a third scenario corresponding to an abnormal medium scenario in which there is an asymmetry with respect to the minimum threshold and the maximum threshold or at least one of the minimum threshold and the maximum threshold is between P25 to P50 or at least one of the minimum threshold and the maximum threshold is between P50 to P75; or a fourth scenario corresponding to an abnormal high scenario in which both of the minimum threshold and the maximum threshold are between P25 to P75, the minimum threshold is between P50 to P75, or the maximum threshold is between P25 to P50.

17. A system, comprising:

one or more processors;

memory accessible to at least one of the one or more processors; and processor-executable instructions stored in the memory and executable to instruct the system to:

receive a digital well plan that specifies planned drilling parameters for drilling a borehole, each of the specified planned drilling parameters comprising one or more of a minimum threshold and a maximum threshold;

generate statistical distributions of actual drilling parameters in real-time responsive to receipt of real-time data acquired during a depth-based window for the drilling, the depth-based window being dynamic and automatically adjustable responsive to rate of penetration for the drilling;

generate comparisons in real-time, each of the comparisons being between one of the statistical distributions and a corresponding one of the planned drilling parameters for the depth-based window;

generate a graphical user interface (GUI) comprising a plurality of tracks respectively corresponding to the generated comparisons, each of the plurality of tracks displaying:

a P5 mark indicating a 5% deviation of the actual drilling parameters from the planned drilling parameters;

a P25 mark indicating a 25% deviation of the actual drilling parameters from the planned drilling parameters;

a P50 mark indicating a 50% deviation of the actual drilling parameters from the planned drilling parameters;

a P75 mark indicating a 75% deviation of the actual drilling parameters from the planned drilling parameters;

a P95 mark indicating a 95% deviation of the actual drilling parameters from the planned drilling parameters;

update the graphical user interface in real-time responsive to the generating statistical distributions of the actual drilling parameters in real-time;

determine, based on the comparisons, that an actual to planned parameter deviation is unacceptable;

issue a control signal in response to the determination that the actual to planned parameter deviation is unacceptable, the control signal comprising a surface equipment control signal to control surface equipment for drilling the borehole or a downhole equipment control signal to control downhole equipment for drilling the borehole; and control the surface equipment or the downhole equipment to control a bottom hole assembly (BHA) to switch between a sliding mode and a rotating mode according to the control signal to return the actual to planned parameter deviation to an acceptable range.

18. One or more non-transitory computer-readable storage media comprising processor-executable instructions to instruct a computing system to:

receive a digital well plan that specifies planned drilling parameters for drilling a borehole, each of the specified planned drilling parameters comprising one or more of a minimum threshold and a maximum threshold;

generate statistical distributions of actual drilling parameters in real-time responsive to receipt of real-time data acquired during a depth-based window for the drilling, the depth-based window being dynamic and automatically adjustable responsive to rate of penetration for the drilling;

generate comparisons in real-time, each of the comparisons being between one of the statistical distributions and a corresponding one of the planned drilling parameters for the depth-based window;

generate a graphical user interface (GUI) comprising a plurality of tracks respectively corresponding to the generated comparisons, each of the plurality of tracks displaying:

a P5 mark indicating a 5% deviation of the actual drilling parameters from the planned drilling parameters;

a P25 mark indicating a 25% deviation of the actual drilling parameters from the planned drilling parameters;

a P50 mark indicating a 50% deviation of the actual drilling parameters from the planned drilling parameters;

a P75 mark indicating a 75% deviation of the actual drilling parameters from the planned drilling parameters;

a P95 mark indicating a 95% deviation of the actual drilling parameters from the planned drilling parameters;

update the graphical user interface in real-time responsive to the generating statistical distributions of the actual drilling parameters in real-time;

determine, based on the comparisons, that an actual to planned parameter deviation is unacceptable;

issue a control signal in response to the determination that the actual to planned parameter deviation is unacceptable, the control signal comprising a surface equipment control signal to control surface equipment for drilling the borehole or a downhole equipment control signal to control downhole equipment for drilling the borehole; and control the surface equipment or the downhole equipment to control a bottom hole assembly (BHA) to switch between a sliding mode and a rotating mode according to the control signal to return the actual to planned parameter deviation to an acceptable range.

* * * * *